US011788384B2

(12) United States Patent
Steele

(10) Patent No.: US 11,788,384 B2
(45) Date of Patent: Oct. 17, 2023

(54) MULTILATERAL JUNCTION INCLUDING ARTICULATING STRUCTURE

(71) Applicant: Halliburton Energy Services, Inc., Houston, TX (US)

(72) Inventor: David Joe Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/239,265

(22) Filed: Apr. 23, 2021

(65) Prior Publication Data

US 2022/0341293 A1 Oct. 27, 2022

(51) Int. Cl.

| | |
|---|---|
| ***E21B 41/00*** | (2006.01) |
| ***E21B 17/18*** | (2006.01) |
| ***E21B 43/14*** | (2006.01) |
| ***E21B 17/046*** | (2006.01) |

(52) U.S. Cl.

CPC ..... *E21B 41/0035* (2013.01); *E21B 17/18* (2013.01); *E21B 43/14* (2013.01); *E21B 17/046* (2013.01)

(58) Field of Classification Search

CPC ..... E21B 41/0035; E21B 17/18; E21B 43/14; E21B 17/046; E21B 17/20

See application file for complete search history.

(56) References Cited

U.S. PATENT DOCUMENTS

| | | | | |
|---|---|---|---|---|
| 4,442,908 | A * | 4/1984 | Steenbock | E21B 4/00 175/73 |
| 4,446,932 | A * | 5/1984 | Hipp | E21B 17/05 175/74 |
| 4,979,585 | A * | 12/1990 | Chesnutt | G01V 1/52 181/102 |
| 8,469,084 | B2 | 6/2013 | Clark et al. | |
| 9,644,459 | B2 * | 5/2017 | Themig | E21B 43/10 |
| 9,945,190 | B2 * | 4/2018 | Crowley | E21B 47/12 |
| 10,794,152 | B2 * | 10/2020 | Lang | E21B 41/0035 |
| 2007/0089875 | A1 | 4/2007 | Steele et al. | |
| 2012/0048623 | A1 | 3/2012 | Lafuente et al. | |
| 2015/0233190 | A1 | 8/2015 | Wolf et al. | |
| 2016/0273312 | A1 | 9/2016 | Steele et al. | |
| 2020/0080402 | A1 * | 3/2020 | Lang | E21B 7/061 |

FOREIGN PATENT DOCUMENTS

| | | | |
|---|---|---|---|
| CA | 2820742 | A1 | 9/2013 |
| WO | 2007047089 | A1 | 4/2007 |
| WO | 2015069886 | A2 | 5/2015 |
| WO | 2016000068 | A1 | 1/2016 |

OTHER PUBLICATIONS

"RapidX, TAML 5 high-strength, hydraulic-sealed multilateral junction," Schlumberger, 1 page, 2016, https://www.slb.com/completions/well-completions/multilaterals/rapidx-hydraulic-sealed-multilateral-junction.

* cited by examiner

*Primary Examiner* — Jonathan Malikasim

(74) *Attorney, Agent, or Firm* — Scott Richardson; Parker Justiss, PC

(57) ABSTRACT

Provided is a wellbore leg, a multilateral junction, and well system. The wellbore leg, in one aspect, includes a tubular having a fluid passageway extending there through, and an articulating structures located within the fluid passageway. In at least one aspect, the articulating structures includes a first portion, and a second portion, wherein the first portion and the second portion are coupled to one another and operable to rotate relative to one another.

29 Claims, 23 Drawing Sheets

MULTILATERAL JUNCTION INCLUDING ARTICULATING STRUCTURE

BACKGROUND

A well can be a multilateral well. A multilateral well can have multiple lateral wellbores that branch off a main wellbore. Wellbore legs may be positioned within the main wellbore (e.g., main wellbore leg) and within the lateral wellbores (e.g., lateral wellbore legs). The wellbore legs may be exposed to forces downhole that can cause the tubing string to collapse and impede fluid flow through the wellbore legs, or burst and prevent fluid flow through the wellbore legs.

BRIEF DESCRIPTION

Reference is now made to the following descriptions taken in conjunction with the accompanying drawings, in which.

DETAILED DESCRIPTION

Figure 1:
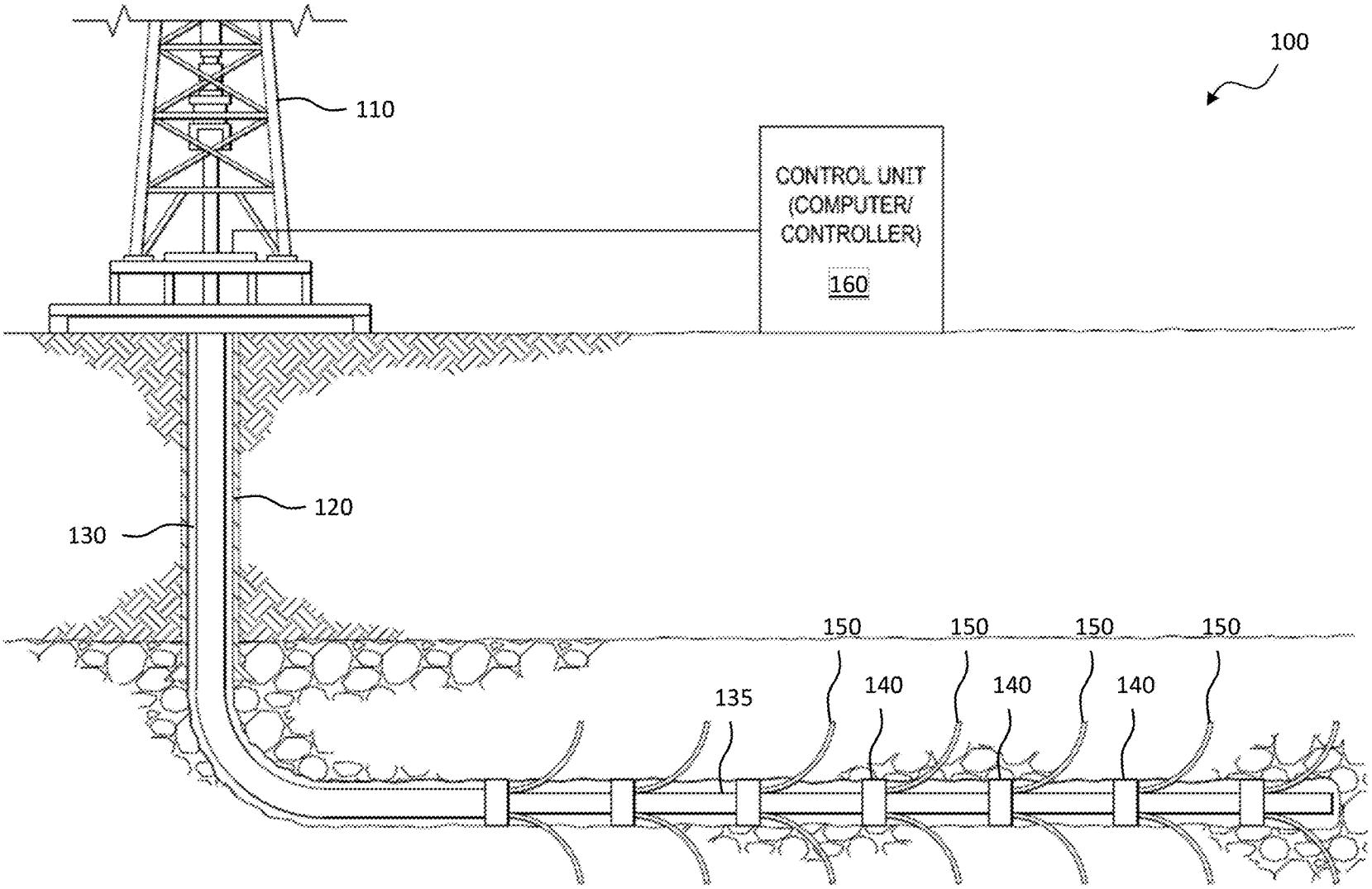
FIG. 1 illustrates a well system for hydrocarbon reservoir production, the well system including a multilateral junction including an articulating structure designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Referring now to FIG. 1, illustrated is a well system 100 for hydrocarbon reservoir production, according to certain example embodiments. The well system 100 in one or more embodiments includes a pumping station 110, a main wellbore 120, tubing 130, 135, which may have differing tubular diameters, and a plurality of multilateral junctions 140, and lateral wellbore legs 150 with additional tubing integrated with a main bore of the tubing 130, 135. Each multilateral junction 140 may comprise a wellbore leg designed, manufactured or operated according to the disclosure. The well system 100 may additionally include a control unit 160. The control unit 160, in one embodiment, is operable to provide control to and/or from the multilateral junctions and/or lateral legs 140, 150, as well as other devices downhole.

Figure 2:
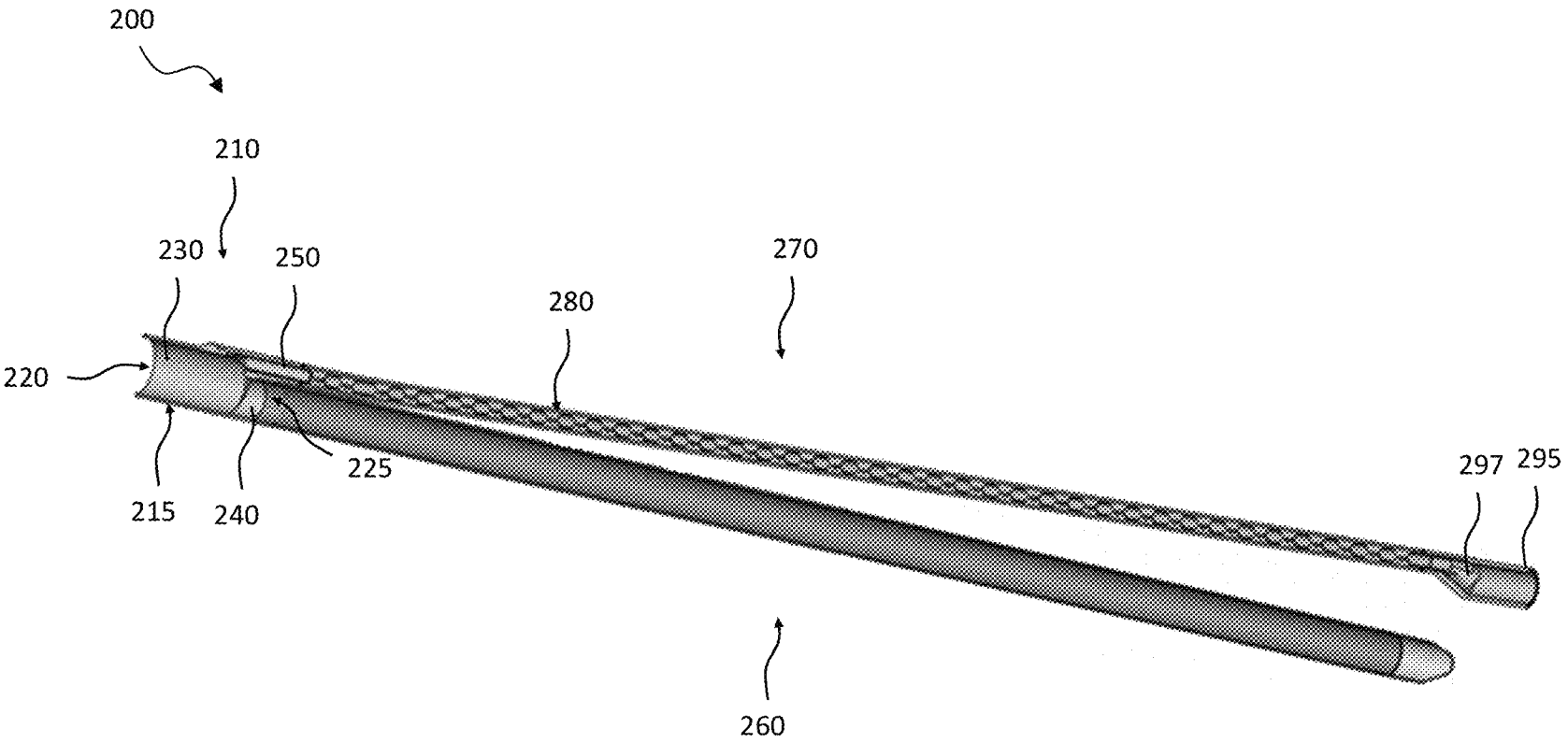
FIG. 2 illustrates a perspective view of a multilateral junction, manufactured and operated according to one or more embodiments of the disclosure.

Turning to FIG. 2, illustrated is a perspective view of a multilateral junction 200 designed, manufactured and operated according to one or more embodiments of the disclosure. The multilateral junction 200 includes a y-block 210, a main wellbore leg 260, and a lateral wellbore leg 270. In the illustrated embodiment, the y-block 210 includes a housing 215. For example, the housing 215 could be a solid piece of metal having been milled to contain various different bores according to the disclosure. In another embodiment, the housing 215 is a cast metal housing formed with the various different bores according to the disclosure. The housing 215, in accordance with one embodiment, may include a first end 220 and a second opposing end 225. The first end 220, in one or more embodiments, is a first uphole end, and the second end 225, in one or more embodiments, is a second downhole end.

The y-block 210, in one or more embodiments, includes a single first bore 230 extending into the housing 215 from the first end 220. The y-block 210, in one or more embodiments, further includes a second bore 240 and a third bore 250 extending into the housing 215 from the second opposing end 225. In the illustrated embodiment, the second bore 240 and the third bore 250 branch off from the single first bore 230 at a point between the first end 220 and the second opposing end 225.

The single first bore 230, second bore 240 and third bore 250, in one or more embodiments, are configured to connect with various different features. For example, in one or more embodiments, the single first bore 230 may include a box joint or a pin joint for engaging with the other uphole features. Similarly, the second bore 240 could include a box joint or a pin joint for engaging with the other downhole features, such as the main wellbore leg 260. In one or more other embodiments, the third bore 250 might include a box joint or a pine joint for engaging with other downhole features, such as the lateral wellbore leg 270. Nevertheless, the present disclosure should not limit the type of joint that any of the single first bore 230, second bore 240 or third bore 250 could employ.

In accordance with one embodiment of the disclosure, the main wellbore leg 260 and the lateral wellbore leg 270 each comprise a tubular having a fluid passageway extending there through. In at least one embodiment, one or both of the main wellbore leg 260 or the lateral wellbore leg 270 includes one or more articulating structures 280 located within the fluid passageway. While the embodiment of FIG. 2 illustrates the one or more articulating structures 280 within the lateral wellbore leg 270, other embodiments exist wherein the articulating structures 280 are located in the main wellbore leg 260, or in both the main wellbore leg 260 and the lateral wellbore leg 270.

While not readily apparent in the embodiment of FIG. 2, for example because of the scale of the drawing, each of the one or more articulating structures 280 may include a first portion and a second portion, wherein the first portion and the second portion are coupled to one another and operable to rotate relative to one another. Accordingly, the articulating structures 280 allow for flexure of the associated main wellbore leg 260 and/or lateral wellbore leg 270 that they are located within. Additionally, the articulating structures 280 provide resistance to the collapse of the main wellbore leg 260 and/or lateral wellbore leg 270, and in certain instances (e.g., if the articulating structures 280 are rigidly coupled to the main wellbore leg 260 and/or lateral wellbore leg 270) may provide resistance to the bursting of the main wellbore leg 260 and/or lateral wellbore leg 270. For example, the articulating structures 280 may assist the multilateral junction 200 in achieving a collapse rating of at least 251 bar (e.g., 3,650 psi) and a burst rating of at least 230 bar (e.g., 3,350 psi) at 121 degrees Centigrade (e.g., 250 degrees Fahrenheit). In the illustrated embodiment, ten or more articulating structures 280 may be located in one or both of the main wellbore leg 260 or lateral wellbore leg 270 for providing the aforementioned flexure, collapse resistance, and burst resistance, as well as axial strength.

In at least one embodiment, one or more of the main wellbore leg 260 or the lateral wellbore leg 270 are D-shaped tubulars. In another embodiment, such as that of FIG. 2, both of the main wellbore leg 260 and the lateral wellbore leg 270 are D-shaped tubulars. Accordingly, in at least one embodiment, the lateral wellbore leg 270 includes a D to round member 295. In at least one embodiment, the D to round member 295 includes a recess 297 large enough to allow the articulating structures 280 to be insert into the wellbore leg that the D to round member 295 is coupled. For example, in the embodiment of FIG. 2, the articulating structures 280 could be insert into the lateral wellbore leg 270 through the D to round member 295.

Figure 3:
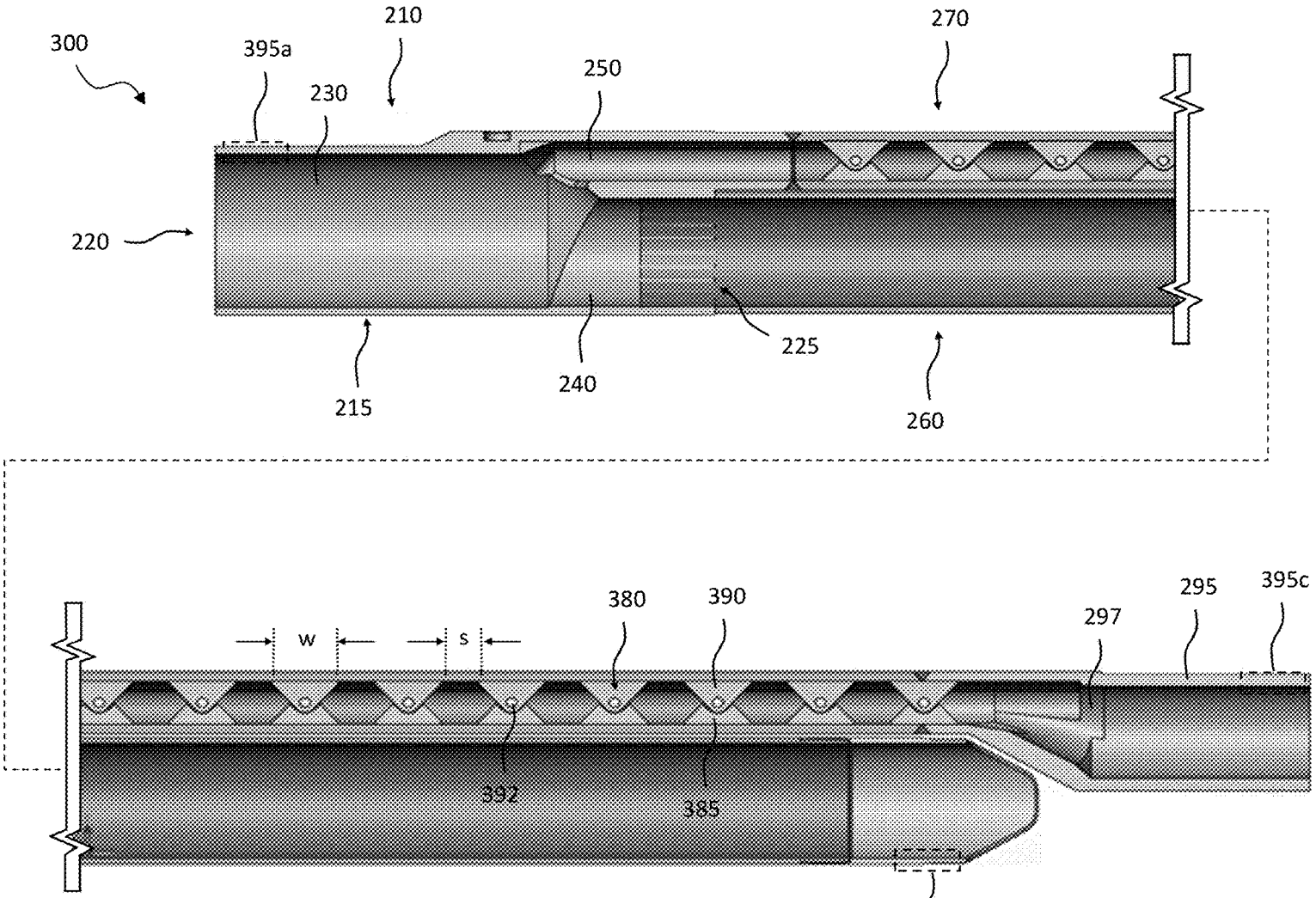
FIG. 3 illustrates a perspective view of a multilateral junction, manufactured and operated according to one or more alternative embodiments of the disclosure.

Turning to FIG. 3, illustrated is a multilateral junction 300 designed, manufactured and operated according to an alternative embodiment of the disclosure. The multilateral junction 300 is similar in many respects to the multilateral junction 200, but is in the collapsed state. Accordingly, like reference numbers have been used to indicate similar, if not identical, features. In the embodiment of FIG. 3, the multilateral junction 300 includes one or more articulating structures 380. Each of the articulating structures 380 have a width (w), and while not shown in the embodiment of FIG. 3, each of the articulating structures 380 also have a thickness (t) and a height (h). In at least one embodiment, each of the articulating structures 380 include a first portion 385 and a second portion 390. In accordance with one embodiment of the disclosure, the first portions 385 and the second portions 390 are coupled to one another and are operable to rotate relative to one another (e.g., about a pin 392).

In at least one embodiment, at least one of the first portions 385 or the second portions 390 are rigidly coupled to a fluid passageway of the lateral wellbore leg 270. In another embodiment, both of the first portions 385 and the second portions are rigidly coupled to the fluid passageway of the lateral wellbore leg 270. While the rigid coupling of the first portions 385 or second portions 390 are not necessary to improve the collapse strength of the lateral wellbore leg 270, the rigid coupling of at least one of the first portions 385 or the second portions 390 are helpful in improving the burst rating of the lateral wellbore leg 270.

Any number of methodologies may be used to rigidly couple the at least one of the first portions 385 or the second portions 390 to the fluid passageway of the lateral wellbore leg 270. In at least one embodiment, one or more welds may be used to create the rigid coupling. In another embodiment, the first portions 385, second portions 390, or both the first portions 385 and the second portions 390 could be exposed through or extend through oppositely oriented slots extending through a sidewall of the lateral wellbore leg 270. For example, ones of the first portions 385 could be exposed through associated first slots in the lateral wellbore leg 270, and ones of the second portions 390 could be exposed through associated second slots in the lateral wellbore leg 270 to form the rigid coupling. With the first portions 385 and the second portions 390 exposed through the associated first slots and second slots, any number of coupling mechanisms could be used. For example, an exterior weld, as well as a pin, a flat head pan bolt, or screw, among others, could be used to make the rigid coupling.

Any number of articulating structures 380 may be used with the multilateral junction 300. Nevertheless, in the embodiment of FIG. 3, the multilateral junction 300 includes ten or more articulating structures 380, and more particularly thirteen or more articulating structures 380. The plurality of articulating structures 380, in at least one embodiment are separated by a spacing (s). The spacing (s) may vary greatly, depending on the multilateral junction 300. In at least one embodiment, the plurality of articulating structures 380 are touching, and thus have a spacing (s) of about zero. In yet other embodiments, however, the spacing (s) is greater than zero. For example, in one or more embodiments, the spacing (s) is less than two times the width (w). In yet other embodiments, the spacing (s) is less than the width (w). In yet even further embodiments, the spacing (s) is less than ½ the width (w). In certain other embodiments, the spacing (s) is greater than zero but less than two times the width (w), and in yet other embodiments the spacing (s) ranges from $1/10^{th}$ the width (w) to the width (w).

In yet another embodiment, one or more of the articulating structures 380 include a locking feature operable to keep the articulating structures 380 in a non-rotated state for installation. Those skilled in the art understand that locking features, such as a pin, a detent, or another structure may be used to keep the articulating structures 380 in the non-rotated state for a period of time, and then release the articulating structures 380 from the non-rotated state. Thus, in at least one embodiment, the locking features may move between a locked state and a non-locked state. In yet another embodiment, the locking features may move between the locked state and the non-locked state regardless of the relative rotation of the articulating structures 380. Accordingly, in certain embodiments the locking features of the articulating structures 380 would be in the locked state when run-in-hole, would move from the locked state to the unlocked state when moving out into the lateral wellbore, and then could return to another locked state when fully deployed in the lateral wellbore. In another embodiment, adjacent articulating structures 380 are axially attached to one another to fix a spacing(s) between adjacent articulating structures 380. As the adjacent articulating structures 380 are axially attached to one another, the collection of articulating structures 380 may be positioned within the wellbore leg and installed in a single step.

In yet another embodiment, the multilateral junction 300 might include one or more Energy Transfer Mechanisms (ETM) 395. The ETMs 395 may be used to provide energy/power/communications/control/data multi-directionally across the multilateral junction 300. For example, in one embodiment, the multilateral junction 300 might include an uphole ETM 395*a*, for example to receive and/or send energy/power/communications/control/data from uphole, from below the junction from devices located below the mainbore leg and/or from below the junction from devices located below the lateral bore leg, or both. A mainbore leg ETM 395*b*, for example to transfer energy/power/communications/control/data between the mainbore leg and the main wellbore, and a lateral bore leg ETM 395*c*, for example to transfer energy/power/communications/control/data between the lateral bore leg and the lateral wellbore. The ETMs 395 have been illustrated in FIG. 3 as being located in the multilateral junction 300, however, other embodiments may exist wherein one or more of the ETMs 395 are located above or below the multilateral junction 300.

An Energy Transfer Mechanism (ETM) may comprise or consist of one or more of the following devices/systems/methods for transferring energy:

1. Electromagnetic Energy
   a. Electric (physical contacts)
      i. Electrical contacts
   b. Electromagnetic waves (non-physical contact, wireless energy transfer mechanism)
      i. Radio, gamma rays, x-rays, microwaves, and ultraviolet light
      ii. Inductive couplers
      iii. Capacitive couplers
2. Mechanical Energy
   a. Movement, Force
   b. Potential and Kinetic Energy and the change between the two
3. Thermal Energy or heat energy
   a. Change of temperature
   b. Change of physical characteristic in response to change in temperature
4. Chemical Energy
   a. Chemical energy results from chemical reactions between atoms or molecules. There are different types of chemical energy, such as electrochemical energy and chemiluminescence.
5. Sonic Energy
   a. energy of sound waves.
6. Gravitational Energy
   a. Energy associated with gravity involves the attraction between two objects based on their mass.
7. Kinetic Energy
   a. Kinetic energy is the energy of motion of a body.
8. Potential Energy
   a. Potential energy is the energy of an object's position.
9. Ionization Energy
   a. Ionization energy is the form of energy that binds electrons to the nucleus of its atom, ion, or molecule.
10. Nuclear Energy
   a. Nuclear energy is energy resulting from changes in the atomic nuclei or from nuclear reactions.
11. Pressure Energy
   a. A mass of fluid acquires pressure energy when it is in contact with other masses having some form of energy. Pressure energy therefore is an energy transmitted to the fluid by another mass that possesses some energy.
12. Energy transformation, also known as energy conversion,
   a. The process of changing energy from one form to another.
   b. Including but not limited to:
      i. Thermoelectric (Heat→Electrical energy)
      ii. Electric generator (Kinetic energy or Mechanical work→Electrical energy)
      iii. Fuel cells (Chemical energy→Electrical energy)
      iv. Battery (electricity) (Chemical energy→Electrical energy)
      v. Microphone (Sound→Electrical energy)
      vi. Wave power (Mechanical energy→Electrical energy)
      vii. Piezoelectrics (Strain→Electrical energy)
      viii. Friction (Kinetic energy→Heat)
      ix. Electric heater (Electric energy→Heat)
      x. Photosynthesis (Electromagnetic radiation→Chemical energy)
      xi. ATP hydrolysis (Chemical energy in adenosine triphosphate→mechanical energy)
13. Multi-step energy transformation, or energy conversion,
   a. Conversion of energy from more than one of the above-mentioned processes
   b. Example: Electric energy→Heat→Electrical energy
   c. Mechanical energy→Sound→Electrical energy
   d. Electrical energy→Mechanical energy→Sound→Electrical energy.
   e. Electrical energy→Battery/Capacitor (Potential energy or Chemical energy)→Electrical energy→Mechanical work
14. Wet-Mate connector
   a. designed to be mated or unmated in wet environments (e.g. underwater) including but not limited to drilling muds, completion fluids, etc.
   b. designed to be mated or unmated in downhole environments (high hydrostatic pressure (1.000-psi to 5.000-psi or higher), high temperatures (100 F to 350 F or higher)
   c. In some embodiments, one or more of the following may be employed:

i. Rubber-molded wet-mate connectors use a locking sleeve and neoprene or polyurethane overmolding to create a water-tight seal between a female connector end and a glass-reinforced epoxy bulkhead connector.

ii. Rigid shell wet-mate connectors are molded into a rigid body, offering greater stability, strength and lockability. The water-locking mechanism involves screwing the two connector halves together and sealing the junction with an O-ring.

iii. Fluid-filled wet-mate connectors use a chamber filled with dielectric fluid, such as oil, to isolate the contacts from water. As the male and female ends are mated, the contact pins are wiped clean by the diaphragm in the face of the receptacle.

iv. Inductive Couplings are pin-less connectors that adjoin magnetically without exposing any conductive parts to the outside environment.

v. Self-insulating contacts comprising Niobium, other Group 5 elements of the Periodic Table, compounds comprising a Group 5 element, and/or other connectors which react peculiarly when energized and exposed to a fluid such as water. Rather than corrode, self-insulating contacts pins may develop a self-insulating film that naturally protects contacts from the harmful effects of fluids such as water.

15. Dry-Mate connector a. Dry mateable, or Dry Mate connectors are connected (mated) above the waterline, and then the connector and cable assembly, and it's related equipment, are taken into the wet environment.

b. Comprise methods and devices similar to those mentioned above in 13*c*.

Figure 4:
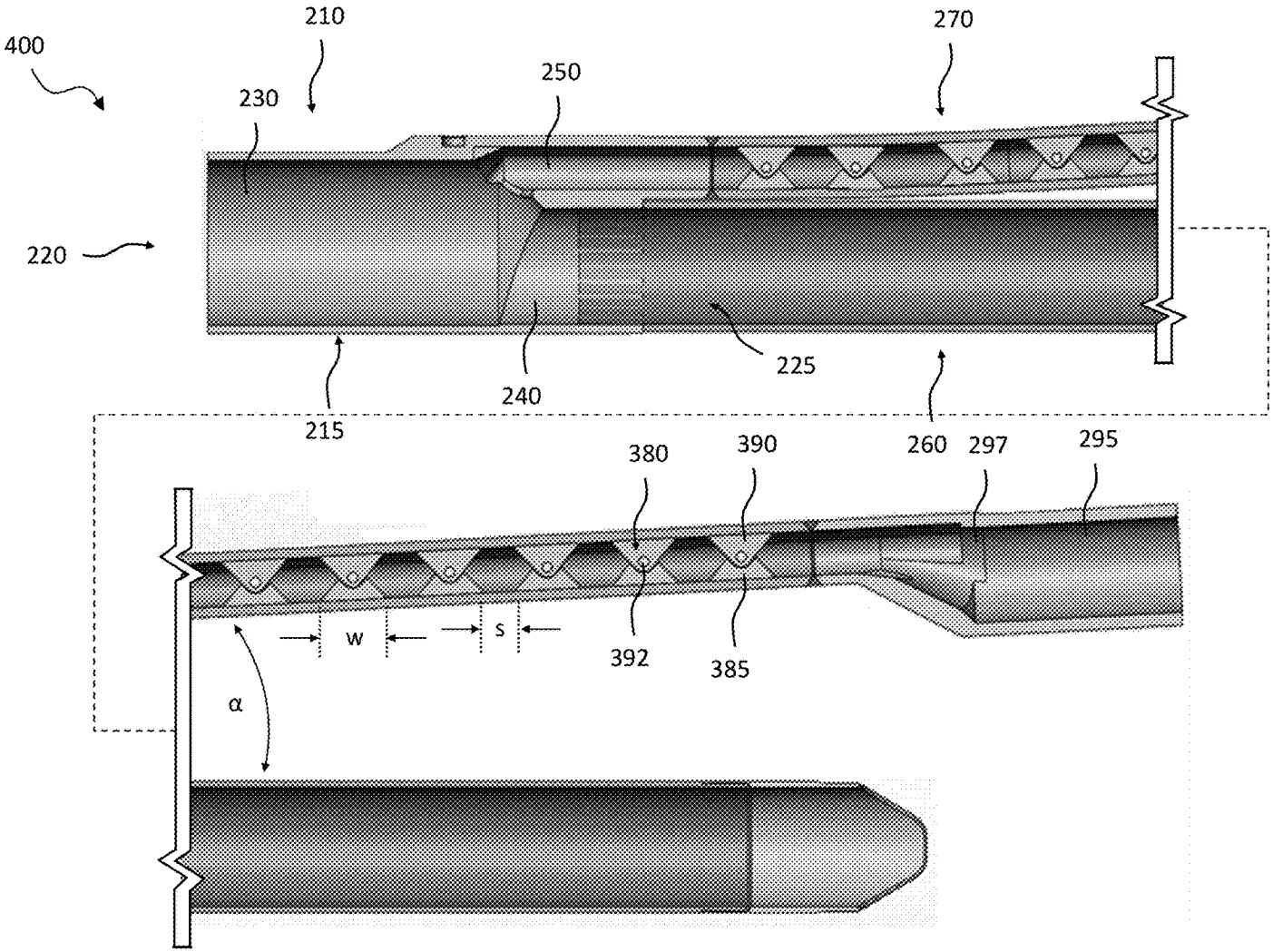
FIG. 4 illustrates a perspective view of a multilateral junction, manufactured and operated according to one or more alternative embodiments of the disclosure.

Turning to FIG. 4, illustrated is a multilateral junction 400 designed, manufactured and operated according to an alternative embodiment of the disclosure. The multilateral junction 400 is similar in many respects to the multilateral junction 300. Accordingly, like reference numbers have been used to indicate similar, if not identical, features. The multilateral junction 400 differs, for the most part, from the multilateral junction 300, in that the multilateral junction 400 is in the articulated state (e.g., deployed or flexed state). Accordingly, the lateral wellbore leg 270 is flexed (e.g., angled) relative to the main wellbore leg 260. For example, the multilateral junction 400 might have a maximum achievable angle ($\alpha$) (e.g., as measured between a center point of two adjacent articulating structures 380) between the lateral wellbore leg 270 and the main wellbore leg 260 while maintaining an improved collapse rating and improved burst rating (e.g., such as the burst and/or collapse ratings discussed above. In at least one embodiment, the maximum achievable angle ($\alpha$) is at least 2 degrees. In at least one other embodiments, the maximum achievable angle ($\alpha$) is a greater angle of at least 3 degrees, and in yet another embodiment a maximum achievable angle ($\alpha$) is a greater angle of at least 5 degrees.

Figure 5B:
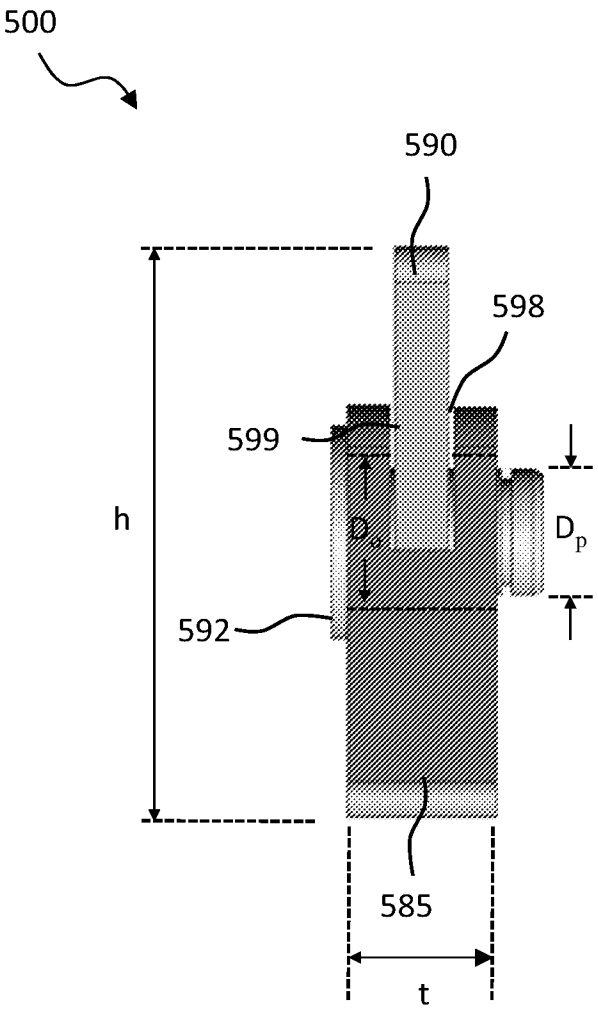
FIGS. 5A and 5B illustrate various different views of an articulating structure designed, manufactured and operated according to one or more embodiments of the disclosure.
Figure 5A:
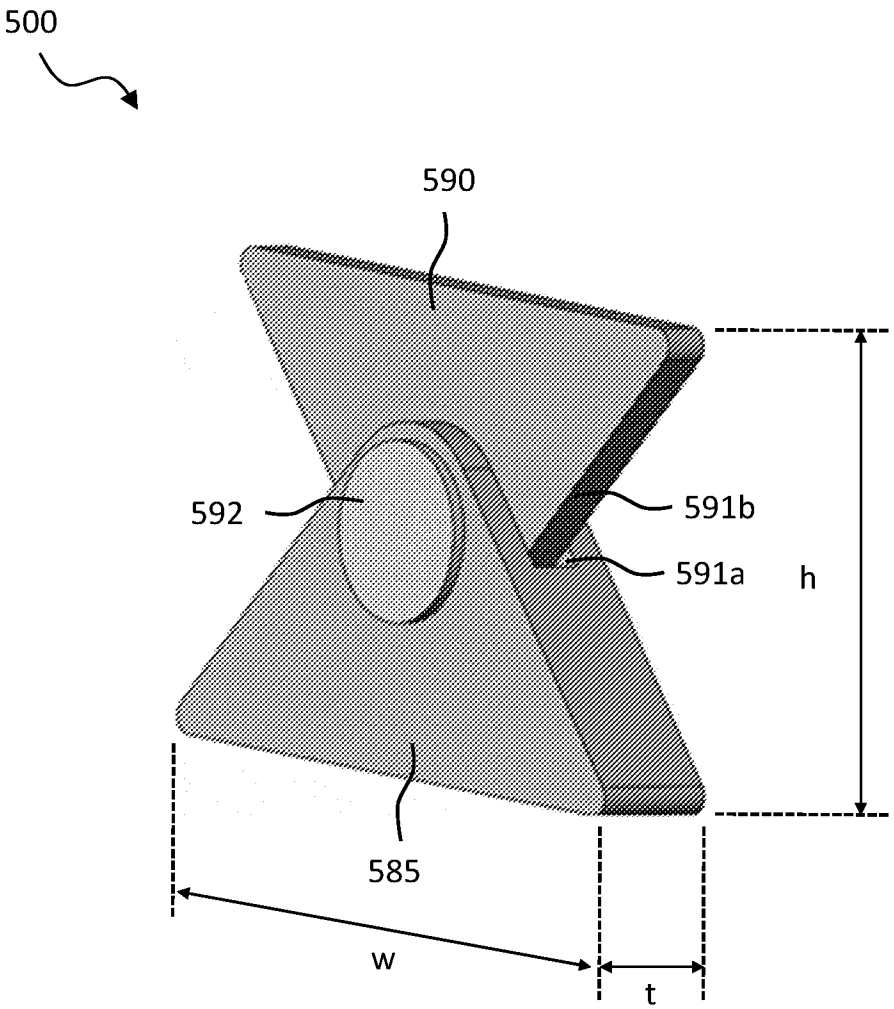

Turning to FIGS. 5A and 5B, illustrated are different views of an articulating structure 580 designed, manufactured and operated according to the disclosure. The articulating structure 580 includes a first portion 585 and a second portion 590, the first portion 585 and the second portion 590 coupled to one another and operable to rotate relative to one another. The articulating structure 580 of FIGS. 5A and 5B have a width (w), a thickness (t), and a height (h). The width (w), thickness (t), and height (h) may vary greatly and remain within the scope of the disclosure. Nevertheless, in at least one embodiment the width (w) ranges from 12 mm to 200 mm, the thickness ranges from 6 mm to 50 mm, and the height ranges from 10 mm to about 200 mm.

In the illustrated embodiment of FIGS. 5A and 5B, the first portion 585 and the second portion 590 include openings extending through their thickness (t). Further to the embodiment of FIGS. 5A and 5B, a rotation member, which may include a pin 592, extends through the openings to provide an axis of rotation, and thus the ability for the first portion 585 and the second portion 590 to rotate relative to one another. In at least one embodiment, the openings have a diameter ($D_o$) and the pin has a diameter ($D_p$). In certain embodiments, the diameter ($D_p$) is less than 98% the diameter ($D_o$). In certain other embodiments, the diameter ($D_p$) is less than 95% the diameter ($D_o$), and in yet other embodiments the diameter ($D_p$) is less than 90% the diameter ($D_o$). The greater difference between the diameter ($D_p$) and the diameter ($D_o$) provides slack that may be helpful for articulation when the spacing (s) between adjacent articulating structures 580 is less than H the width (w), as well as when the adjacent articulating structures 580 are touching.

In the illustrated embodiment of FIGS. 5A and 5B, at least one of the first portion 585 or the second portion 590 includes a groove 591*a*, and the other of the second portion 590 or the first portion 585 includes a tongue 591*b* that is operable to extend within the groove. In the embodiment of FIG. 5, the first portion 585 includes the groove 591*a* and the second portion 590 includes the tongue 591*b*. Accordingly, when subjected to a compressive or expansive force, the articulating structure 580 includes two separate shear planes through the pins 592.

Figure 6:
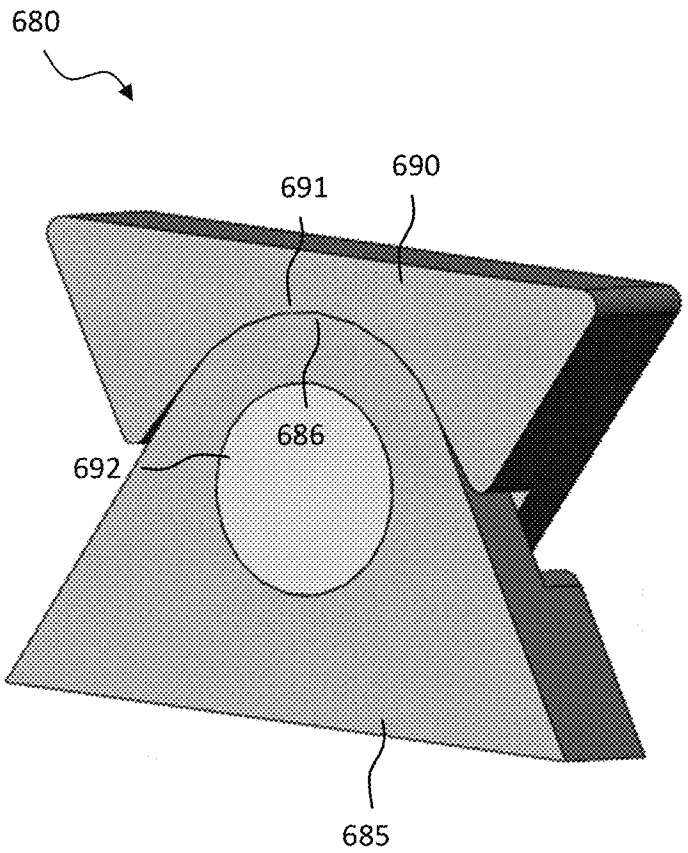
FIG. 6 illustrates an articulating structure designed, manufactured and operated according to one or more alternative embodiments of the disclosure.

Turning to FIG. 6, illustrated is an articulating structure 680 designed, manufactured and operated according to an alternative embodiment of the disclosure. The articulating structure 680 is similar in many respects to the articulating structure 580. Accordingly, like reference numbers have been used to indicate similar, if not identical, features. The articulating structure 680 differs, for the most part, from the articulating structure 580, in that the first portion 685 and the second portion 690 of the articulating structure 680 include associated bearing surfaces 686, 691, respectively, that rotate against each other. The bearing surfaces 686, 691, in at least this embodiment, reduce any compressive forces on the pin 692, and thus any compressive shear forces on the pin 692, as the bearing surfaces 686, 691 bear substantially all, if not entirely all, of the compressive forces places upon the articulating structure 680. The articulating structure 680, in contrast to the articulating structure 580 of FIGS. 5A and 5B, includes only a single shear plane through the pin 692.

Figure 7:
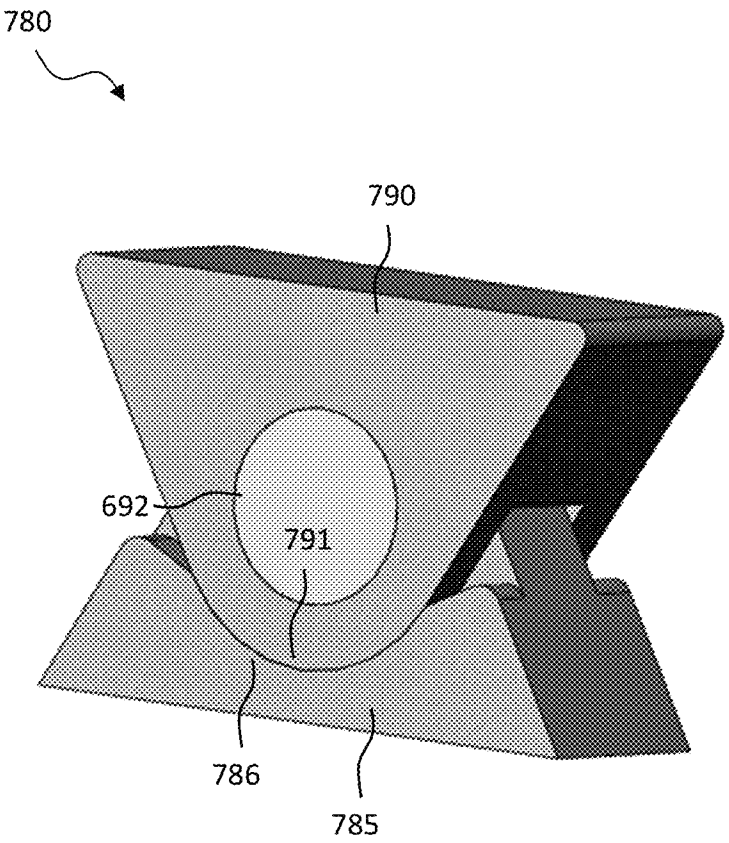
FIG. 7 illustrates an articulating structure designed, manufactured and operated according to one or more alternative embodiments of the disclosure.

Turning to FIG. 7, illustrated is an articulating structure 780 designed, manufactured and operated according to an alternative embodiment of the disclosure. The articulating structure 780 is similar in many respects to the articulating structure 680. Accordingly, like reference numbers have been used to indicate similar, if not identical, features. The articulating structure 780 differs, for the most part, from the articulating structure 680, in that at least one of the first portion 785 or the second portion 790 includes a groove feature, and the other of the second portion 790 or the first portion 785 includes a tongue feature. In the embodiment of FIG. 7, the first portion 785 includes the tongue feature and the second feature 790 includes the groove feature. Thus, according to the embodiment of FIG. 7, the tongue feature of the first portion 785 slides within the groove feature of the second portion 790, to form the associated bearing surfaces 786, 791, respectively, for the first portion 785 and the second portion 790 to rotate against. The bearing surfaces 786, 791, in at least this embodiment, reduce any compressive forces on the pin 692, and thus any compressive shear forces on the pin 692, as the bearing surfaces 786, 791 bear substantially all, if not entirely all, of the compressive forces places upon the articulating structure 780. The articulating structure 780, in contrast to the articulating structure 680 of FIG. 6, includes two separate shear planes through the pin 692, for example as a result of the tongue and groove features.

Figure 8A:
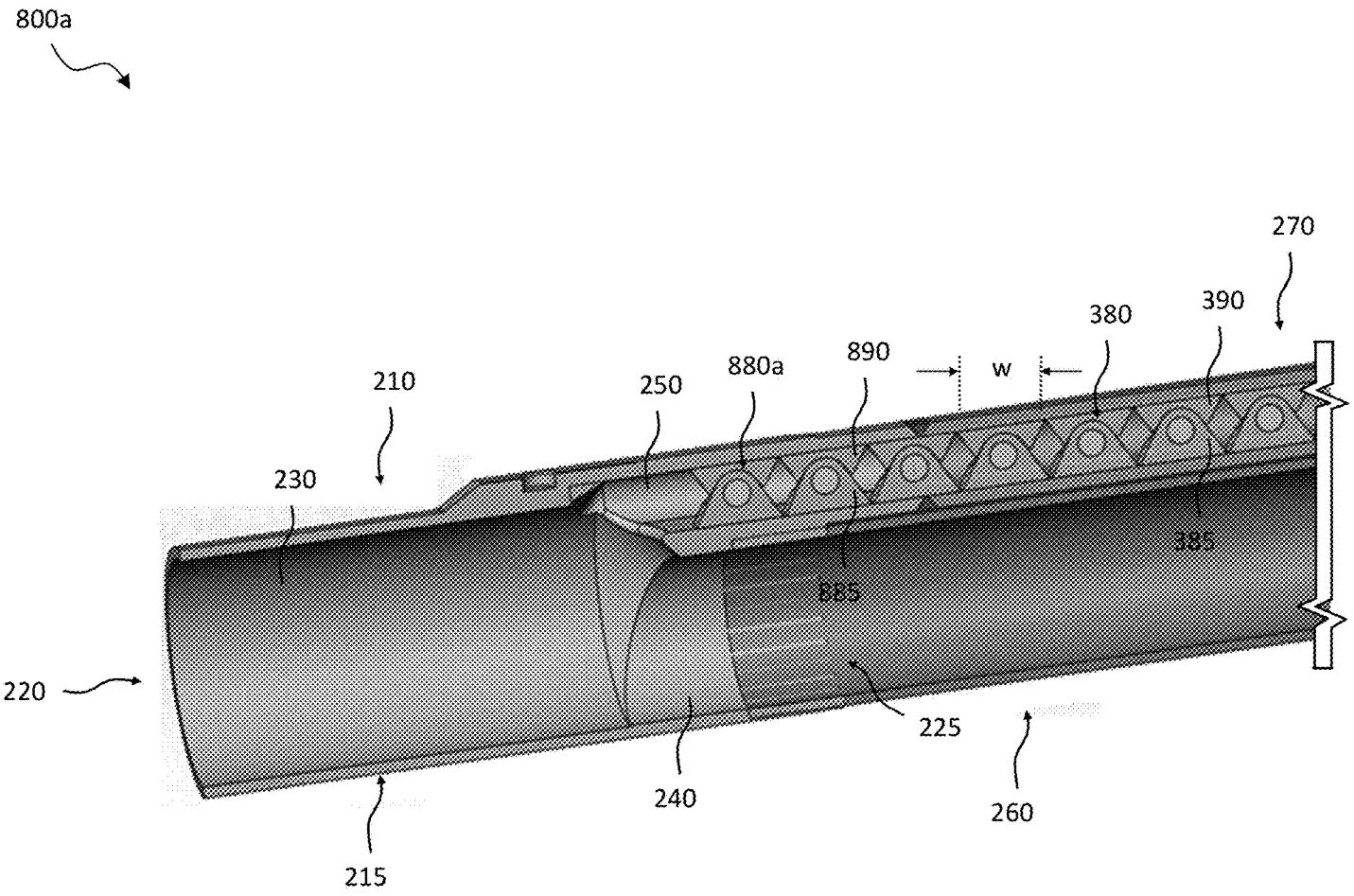
FIG. 8A illustrates a perspective view of a multilateral junction, manufactured and operated according to one or more alternative embodiments of the disclosure.

Turning to FIG. 8A, illustrated is a multilateral junction 800*a* designed, manufactured and operated according to an alternative embodiment of the disclosure. The multilateral junction 800*a* is similar in many respects to the multilateral junction 300. Accordingly, like reference numbers have been used to indicate similar, if not identical, features. The multilateral junction 800*a* differs, for the most part, from the multilateral junction 300, in that the multilateral junction 800*a* includes one or more support structures 880*a* positioned within at least one of the second bore 240 or the third bore 250, or both of the second bore 240 and the third bore 250, of the y-block 210. In the embodiment of FIG. 8A, the support structures 880*a* are located in the third bore 250 and include a first portion 885 and a second portion 890. The first portions 885 and the second portions 890, in at least one embodiment, may be coupled to one another and operable to rotate relative to one another, and thus function as y-block articulating structures. In another embodiment, the first portions 885 and the second portions 890 of the support structure 880*a* are rigidly coupled to one another, and thus are not operable to rotate relative to one another.

Figure 8B:
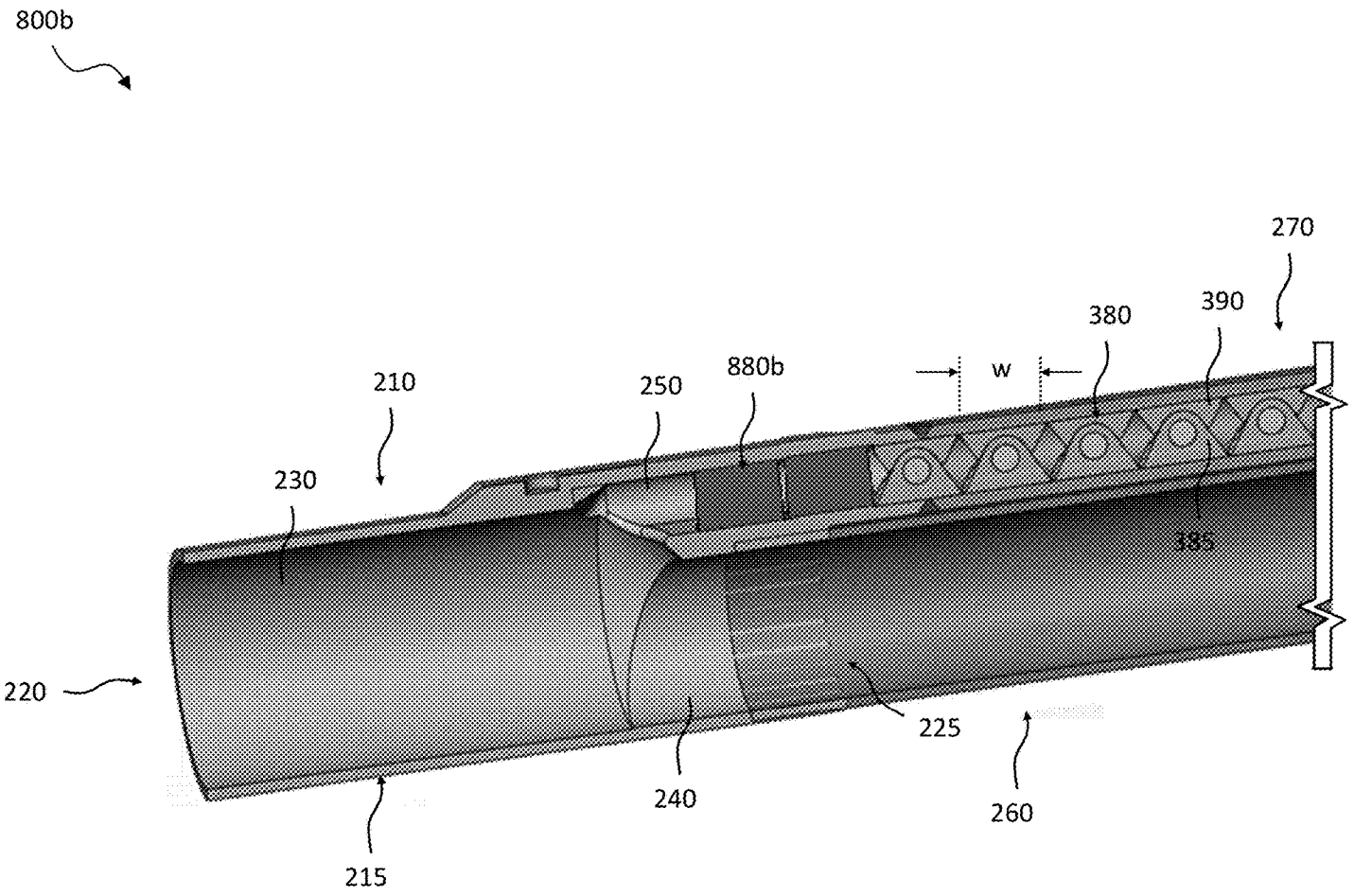
FIG. 8B illustrates a perspective view of a multilateral junction, manufactured and operated according to one or more alternative embodiments of the disclosure.

Turning to FIG. 8B, illustrated is a multilateral junction 800*b* designed, manufactured and operated according to an alternative embodiment of the disclosure. The multilateral junction 800*b* is similar in many respects to the multilateral junction 800*a*. Accordingly, like reference numbers have been used to indicate similar, if not identical, features. The multilateral junction 800*b* differs, for the most part, from the multilateral junction 800*a*, in that the multilateral junction 800*b* includes one or more rigid support structures 880*b*. In the embodiment, of FIG. 8B, the one or more rigid support structures 880*b* are each a single unit, and thus do not include the first portions 885 and the second portions 890 of the support structure 880*a* of FIG. 8A.

Figure 9:
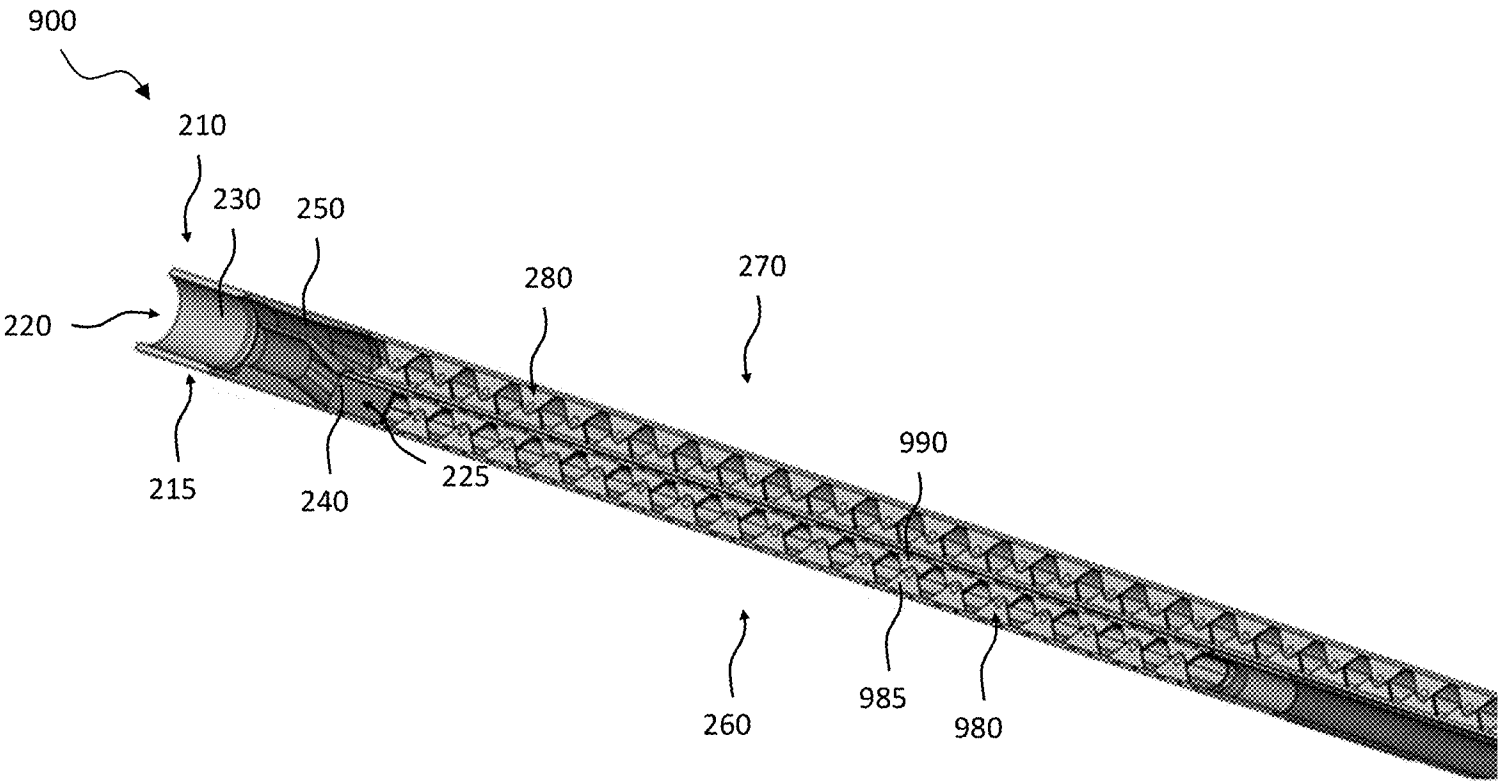
FIG. 9 illustrates a perspective view of a multilateral junction, manufactured and operated according to one or more alternative embodiments of the disclosure.

Turning to FIG. 9, illustrated is a multilateral junction 900 designed, manufactured and operated according to an alternative embodiment of the disclosure. The multilateral junction 900 is similar in many respects to the multilateral junction 200. Accordingly, like reference numbers have been used to indicate similar, if not identical, features. The multilateral junction 900 differs, for the most part, from the multilateral junction 200, in that the multilateral junction 900 also includes support structures 980 in the main wellbore leg 260. The support structures 980 may be articulating structures (e.g., and include a first portion 985 that rotates relative to a second portion 990) similar to the embodiment of FIG. 8A, or may be rigid support structures (e.g., whether including only a single unit, or the first portion 985 and the second portion 990) similar to the embodiment of FIG. 8B.

Figure 10:
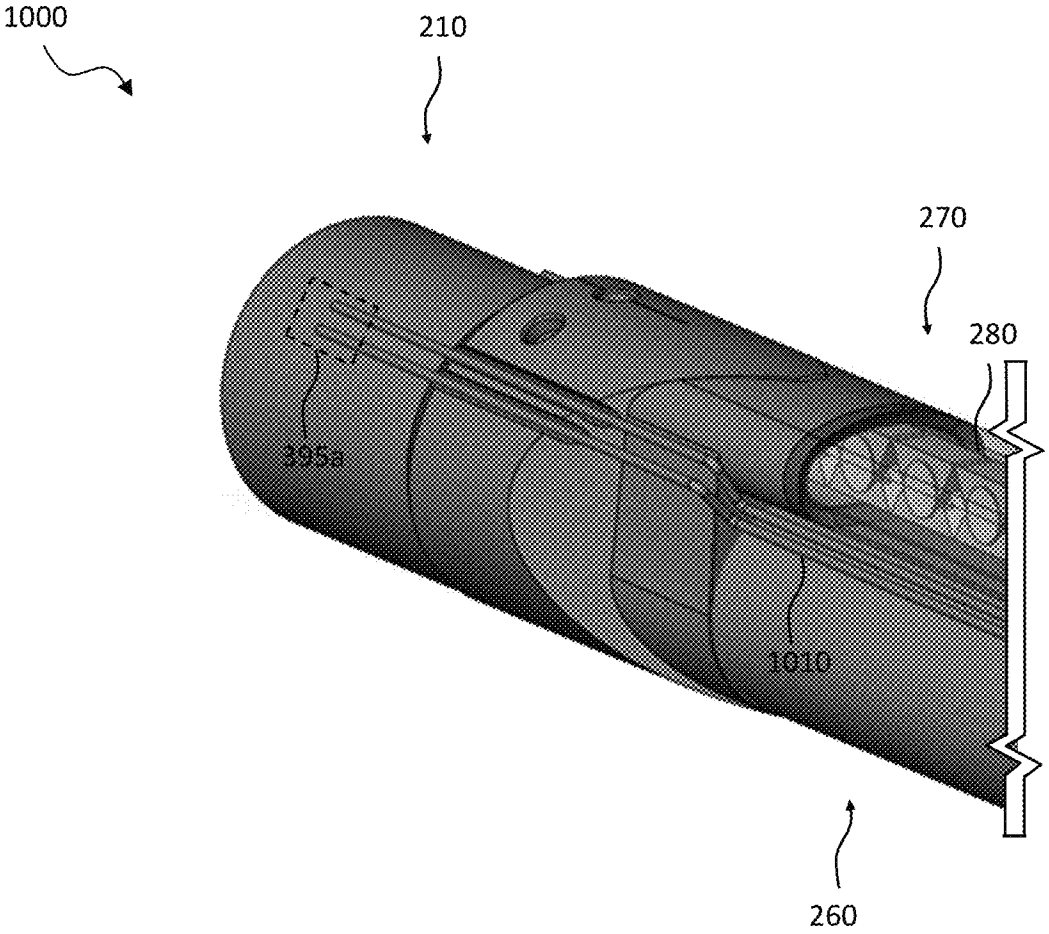
FIG. 10 illustrates a perspective view of a multilateral junction, manufactured and operated according to one or more alternative embodiments of the disclosure.

Turning to FIG. 10, illustrated is a multilateral junction 1000 designed, manufactured and operated according to an alternative embodiment of the disclosure. The multilateral junction 1000 is similar in many respects to the multilateral junction 300. Accordingly, like reference numbers have been used to indicate similar, if not identical, features. The multilateral junction 1000 differs, for the most part, from the multilateral junction 300, in that the multilateral junction 1000 includes one or more control lines 1010. The one or more control lines 1010, in the illustrated embodiment, are run along an exterior of the multilateral junction 1000, nevertheless, other embodiments exist wherein the one or more control lines 1010 are run along an interior of the multilateral junction 1000. The one or more control lines 1010 may, in certain embodiments, be associated with one of the main wellbore leg 260, the lateral wellbore leg 270, or both of the main wellbore leg 260 and the lateral wellbore leg 270. In yet other embodiments, the one or more control lines are associated with other features downhole of the multilateral junction 1000.

The one or more control lines 1010 may vary greatly in design or use and remain within the scope of the present disclosure. For example, in one embodiment the one or more control lines 1010 are one or more hydraulic control lines. In yet another embodiment, the one or more control lines 1010 are one or more electric control lines. In even yet another embodiment, the one or more control lines 1010 are one or more fiber control lines, or alternatively another energy transfer mechanism according to the disclosure. In even yet another embodiment, the one or more control lines 1010 are one or more hydraulic control lines, one or more electric control lines, one or more fiber control lines, or alternatively another ETM, such as the ETM 395*a*. Furthermore, while the ETM 395*a* is the only ETM illustrated in FIG. 10, one or more of ETMs 395*b* and/or 395*c* could be located at the opposing end of the multilateral junction 1000.

Figure 11:
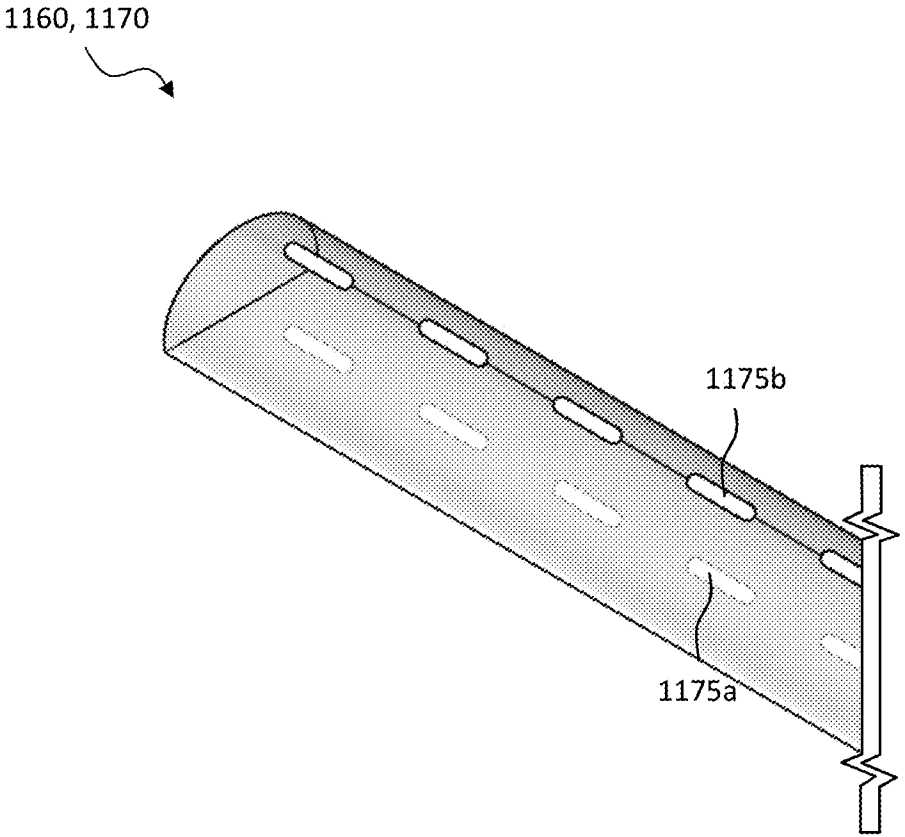
FIG. 11 illustrates a wellbore leg designed, manufactured and operated according to an alternative embodiment of the disclosure.

Turning to FIG. 11, illustrated is a wellbore leg 1160, 1170 designed, manufactured and operated according to an alternative embodiment of the disclosure. The wellbore leg 1160, 1170 is similar in many respects to one of the wellbore legs 260, 270 of FIG. 2. Accordingly, like reference numbers have been used to indicate similar, if not identical, features. The wellbore leg 1160, 1170, in one or more embodiments, includes a plurality of first and second oppositely oriented slots (e.g., milled slots) 1175*a*, 1175*b* extending through a sidewall thereof. While not shown, first portions of articulating structures might extend into the first slots 1175*a*, and second portions of the articulating structures might extend into the second slots 1175*b*. Alternatively, first portions of articulating structures would sit flush with an internal or external surface of the first slots 1175*a*, and second portions of the articulating structures would sit flush with an internal or external surface of the second slots 1175*b*. Accordingly, the plurality of first and second oppositely oriented slots 1175*a*, 1175*b* could be used to rigidly couple the first portions and the second portions to the wellbore leg 1160, 1170.

In the embodiment of FIG. 11, the wellbore leg 1160, 1170 is a lateral wellbore leg. In fact, in the embodiment of FIG. 11, the wellbore leg 1160, 1170 is a D-shaped lateral wellbore leg. In other embodiments, however, the wellbore leg 1160, 1170 could be the main wellbore leg, whether D-shaped or not. Accordingly, the first and second oppositely oriented slots 1175*a*, 1175*b* of the present disclosure are not limited to either the main wellbore leg or the lateral wellbore leg.

Figure 12:
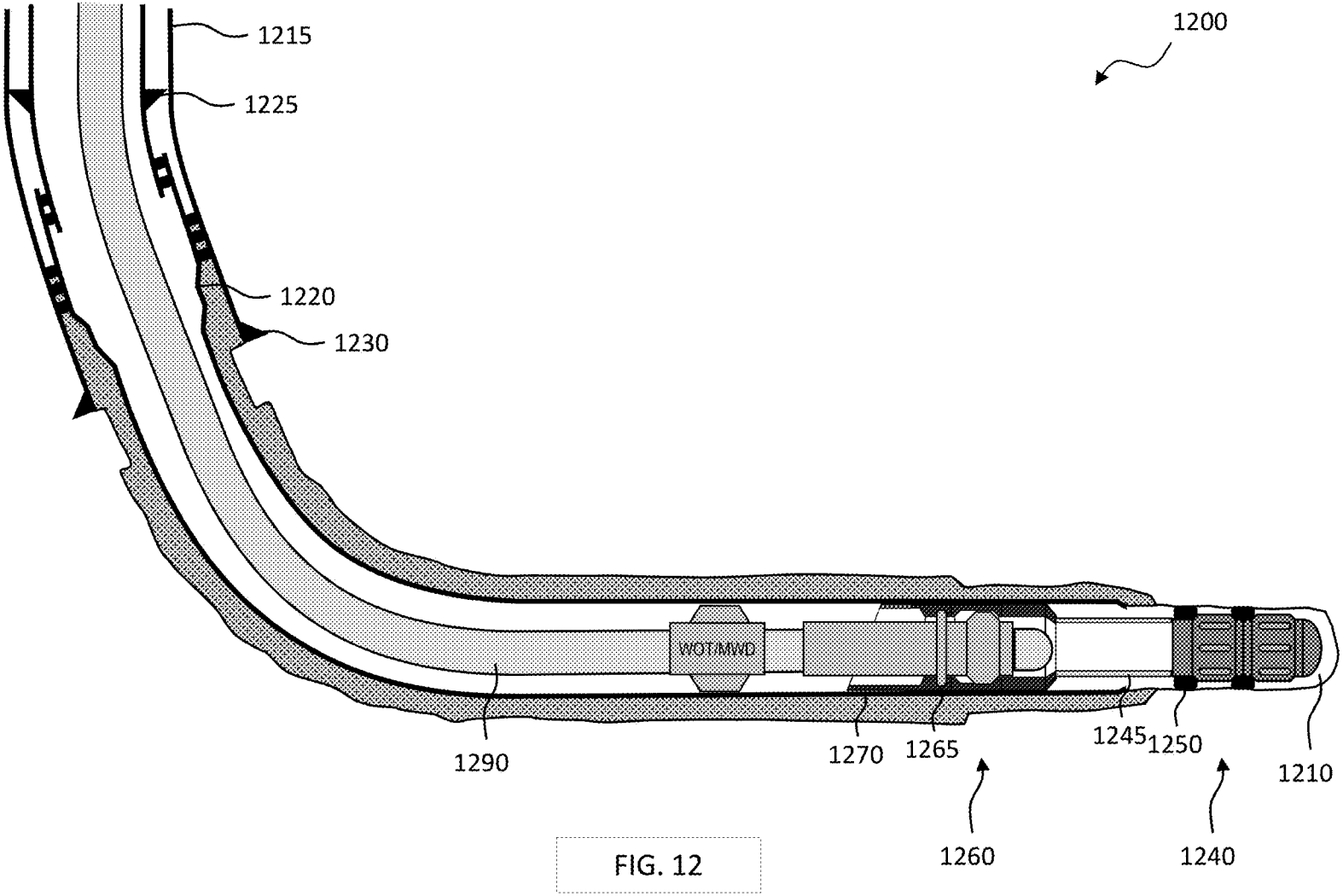
FIGS. 12 through 23 illustrate a method for forming, fracturing and/or producing from a well system.

Turning now to FIGS. 12 through 23, illustrated is a method for forming, accessing, potentially fracturing, and producing from a well system 1200. FIG. 12 is a schematic of the well system 1200 at the initial stages of formation. A main wellbore 1210 may be drilled, for example by a rotary steerable system at the end of a drill string and may extend from a well origin (not shown), such as the earth's surface or a sea bottom. The main wellbore 1210 may be lined by one or more casings 1215, 1220, each of which may be terminated by a shoe 1225, 1230.

The well system 1200 of FIG. 12 additionally includes a main wellbore completion 1240 positioned in the main wellbore 1210. The main wellbore completion 1240 may, in certain embodiments, include a main wellbore liner 1245 (e.g., with frac sleeves in one embodiment), as well as one or more packers 1250 (e.g., swell packers in one embodiment). The main wellbore liner 1245 and the one or more packer 1250 may, in certain embodiments, be run on an anchor system 1260. The anchor system 1260, in one embodiment, includes a collet profile 1265 for engaging with the running tool 1290, as well as a muleshoe 1270 (e.g., slotted alignment muleshoe). In at least one embodiment, the anchor system 1260, may include an Energy Transfer Mechanism (ETM), a Wireless Energy Transfer Mechanism, and/or a Wet-Mate for energy/power/communications/control/data transfer.

Anchor system 1260, in one or more embodiments, may comprise one or more sensor, recorder, actuator, choking mechanism, flow restrictor, pressure-drop device, venturi tube containing device. In at least one embodiment, anchor system 1260 may comprise a control line, a production and reservoir management system with in-situ measurements of pressure, temperature, flow rate, and water cut across the formation face in multiple zones of each wellbore. Sensors may be packaged in one station with a flow control valve that has variable settings controlled from surface through one or more electrical, fiber optic, hydraulic control lines. Multiple stations may be used to maximize hydrocarbon sweep and recovery with fewer wells, reducing capex, opex, and surface footprint.

A standard workstring orientation tool (WOT) and measurement while drilling (MWD) tool may be coupled to the running tool 1290, and thus be used to orient the anchor system 1260. In at least one embodiment main wellbore completion 1240 may comprise an Energy Transfer Mechanism (ETM), a Wireless Energy Transfer Mechanism, and/or a Wet-Mate for energy/power/communications/control/data transfer. Main wellbore completion 1240, in one or more embodiments, may comprise one or more sensor, recorder, actuator, choking mechanism, flow restrictor, pressure-drop device, venturi tube containing device.

In at least one embodiment, main wellbore completion 1240 may comprise a control line, a production and reservoir management system with in-situ measurements of pressure, temperature, flow rate, and water cut across the formation face in multiple zones of each wellbore. Sensors may be packaged in one station with a flow control valve that has variable settings controlled from surface through one or more electrical, fiber optic, hydraulic control lines. Multiple stations may be used to maximize hydrocarbon sweep and recovery with fewer wells, reducing capex, opex, and surface footprint.

Figure 13:
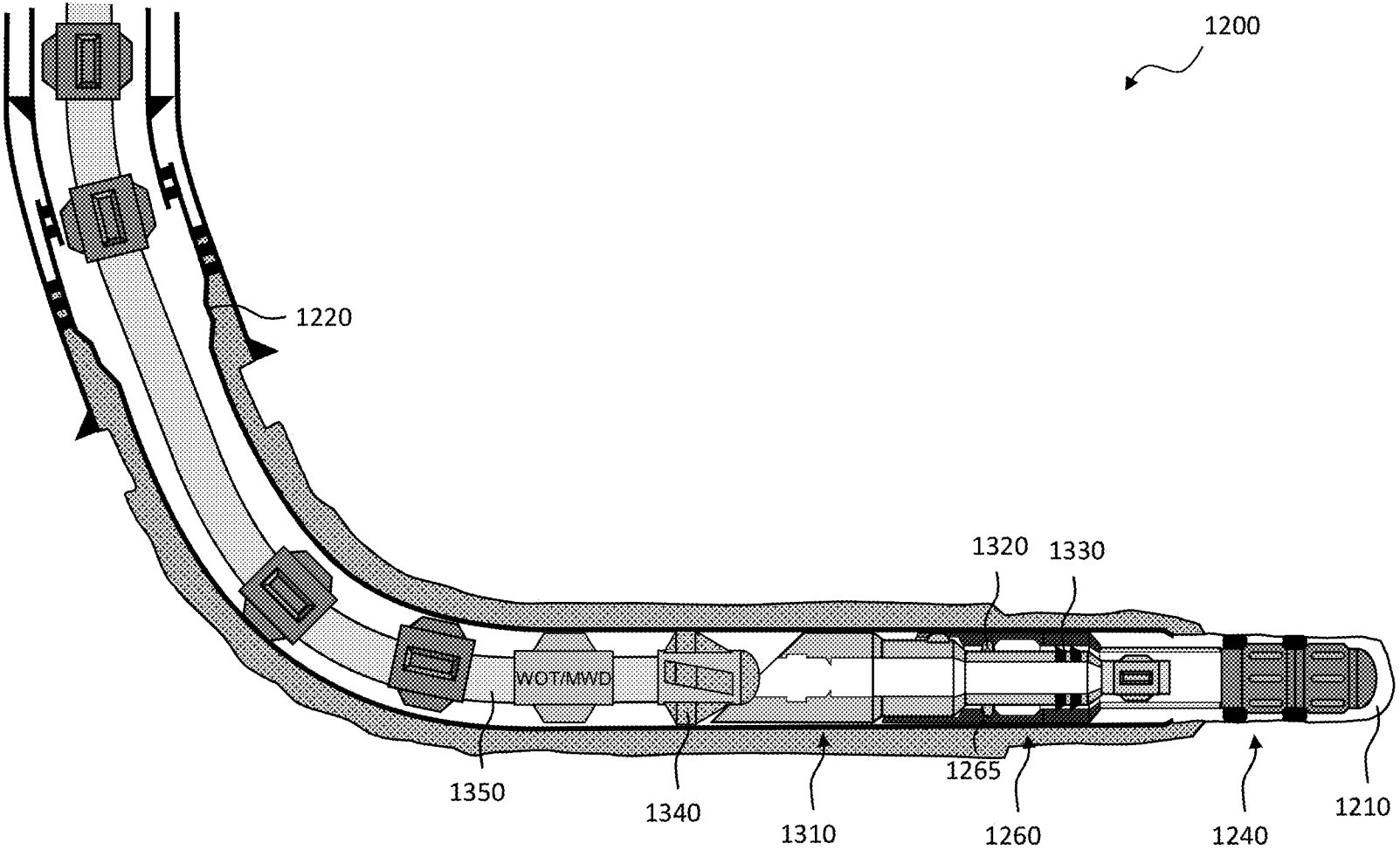

Turning to FIG. 13, illustrated is the well system 1200 of FIG. 12 after positioning a whipstock assembly 1310 downhole at a location where a lateral wellbore is to be formed. The whipstock assembly 1310 includes a collet 1320 for engaging the collet profile 1265 in the anchor system 1260. The whipstock assembly 1310 additionally includes one or more seals 1330 (e.g., a wiper set in one embodiment) to seal the whipstock assembly 1310 with the main wellbore completion 1240. In certain embodiments, such as that shown in FIG. 13, the whipstock assembly 1310 is made up with a lead mill 1340, for example using a shear bolt, and then run in hole on a drill string 1350. The WOT/MWD tool may be employed to orient the whipstock assembly 1310.

Figure 14:
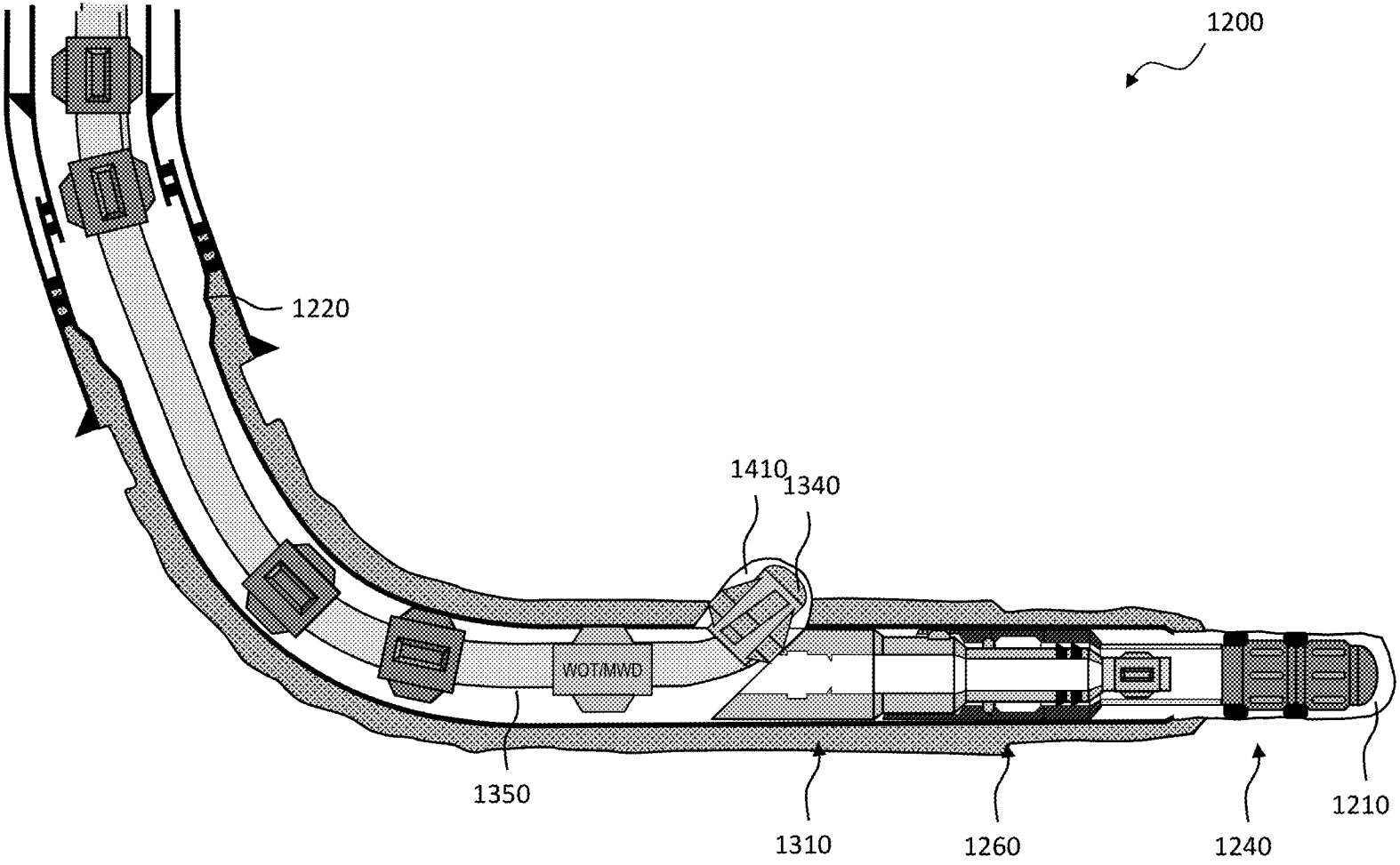

Turning to FIG. 14, illustrated is the well system 1200 of FIG. 13 after setting down weight to shear the shear bolt between the lead mill 1340 and the whipstock assembly 1310, and then milling an initial window pocket 1410. In certain embodiments, the initial window pocket 1410 is between 1.5 m and 12.0 m long, and in certain other embodiments about 2.5 m long, and extends through the casing 1220. Thereafter, a circulate and clean process could occur, and then the drill string 1350 and lead mill 1340 may be pulled out of hole.

Figure 15:
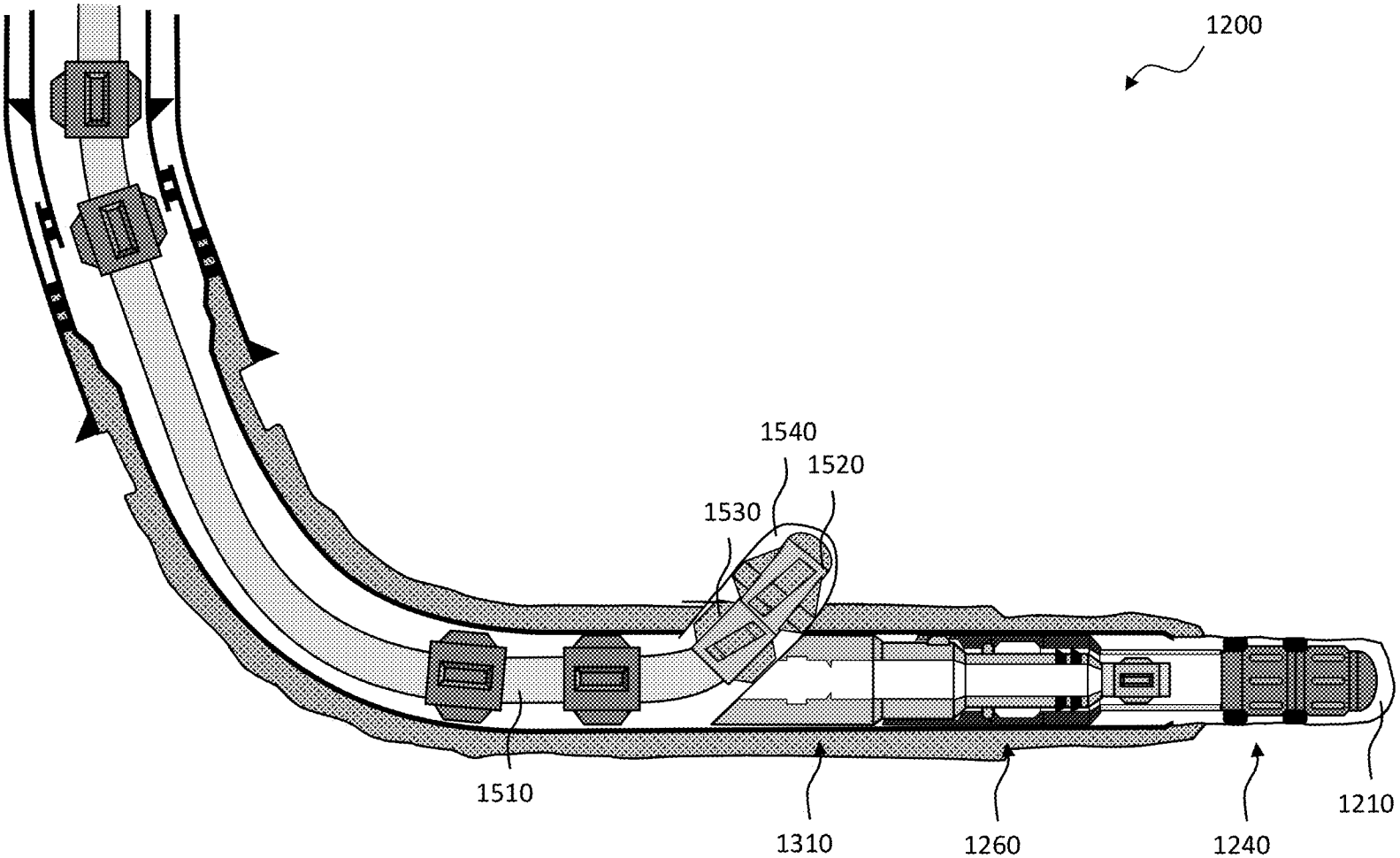

Turning to FIG. 15, illustrated is the well system 1200 of FIG. 14 after running a lead mill 1520 and watermelon mill 1530 downhole on a drill string 1510. In the embodiments shown in FIG. 15, the drill string 1510, lead mill 1520 and watermelon mill 1530 drill a full window pocket 1540 in the formation. In certain embodiments, the full window pocket 1540 is between 5 m and 15 m long, and in certain other embodiments about 13.5 m long. Thereafter, a circulate and clean process could occur, and then the drill string 1510, lead mill 1520 and watermelon mill 1530 may be pulled out of hole.

Figure 16:
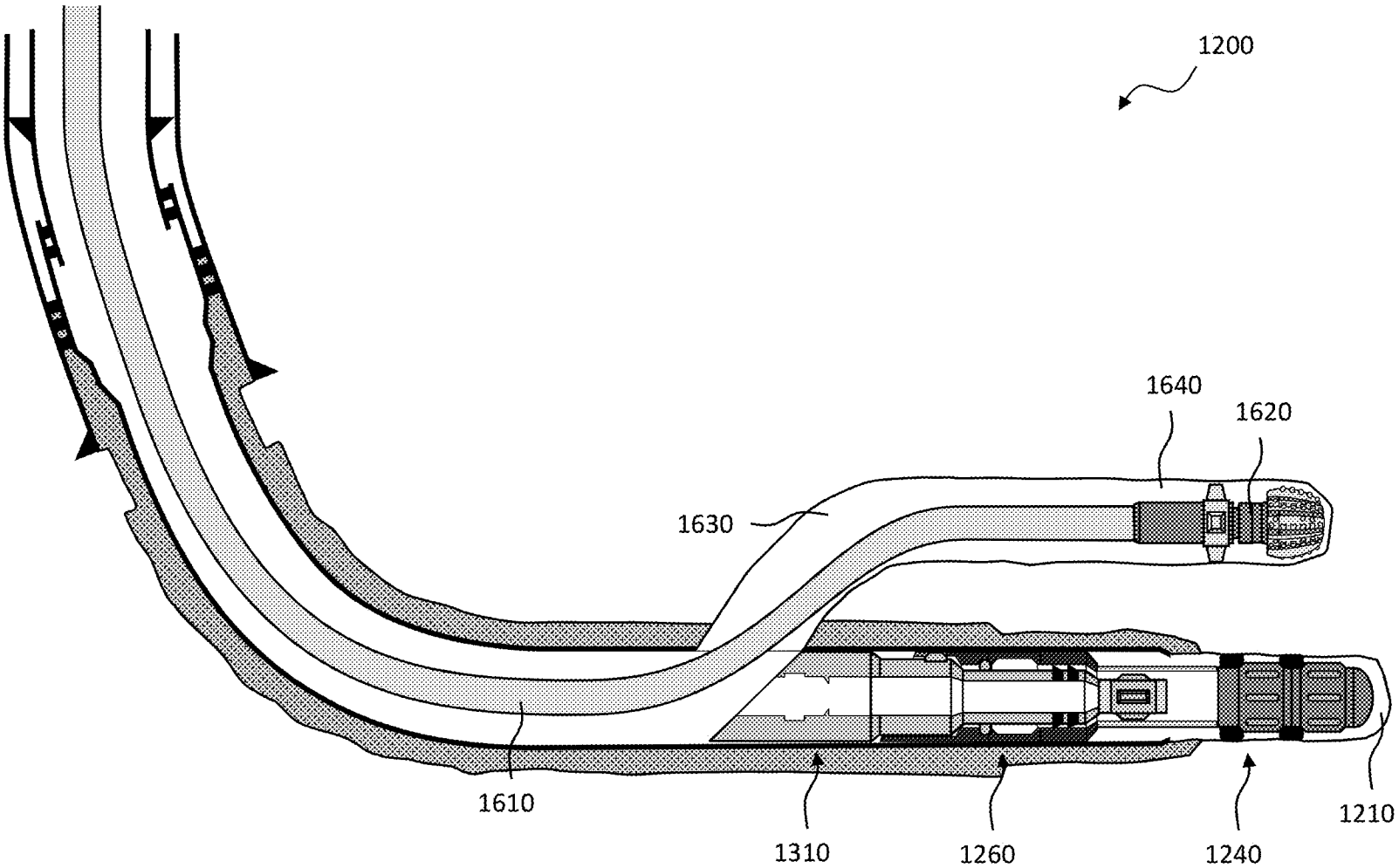

Turning to FIG. 16, illustrated is the well system 1200 of FIG. 15 after running in hole a drill string 1610 with a rotary steerable assembly 1620, drilling a tangent 1630 following an inclination of the whipstock assembly 1310, and then continuing to drill the lateral wellbore 1640 to depth. Thereafter, the drill string 1610 and rotary steerable assembly 1620 may be pulled out of hole.

Figure 17:
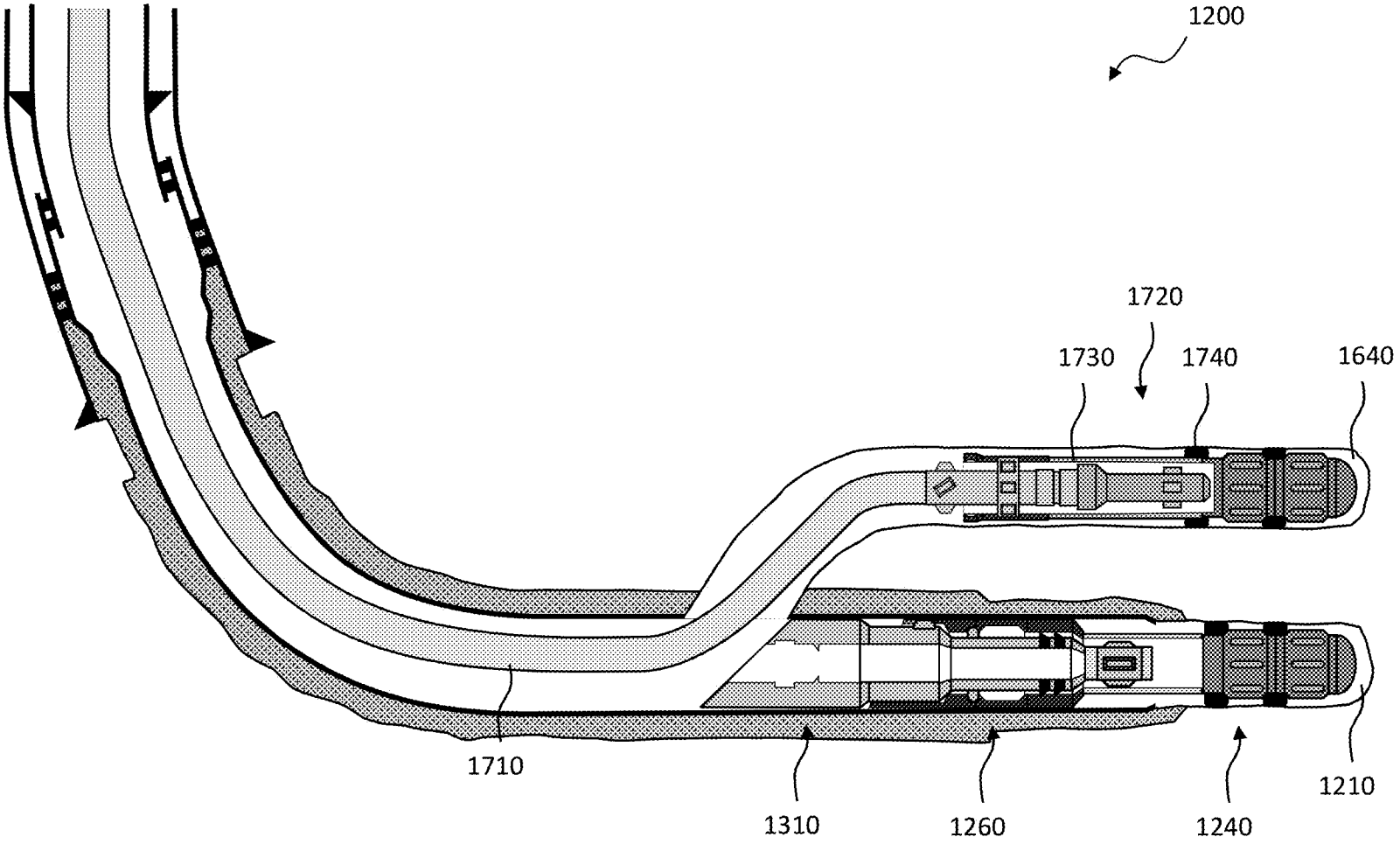

Turning to FIG. 17, illustrated is the well system 1200 of FIG. 16 after employing an inner string 1710 to position a lateral wellbore completion 1720 in the lateral wellbore 1640. The lateral wellbore completion 1720 may, in certain embodiments, include a lateral wellbore liner 1730 (e.g., with frac sleeves in one embodiment), as well as one or more packers 1740 (e.g., swell packers in one embodiment). Thereafter, the inner string 1710 may be pulled into the main wellbore 1210 for retrieval of the whipstock assembly 1310.

Figure 18:
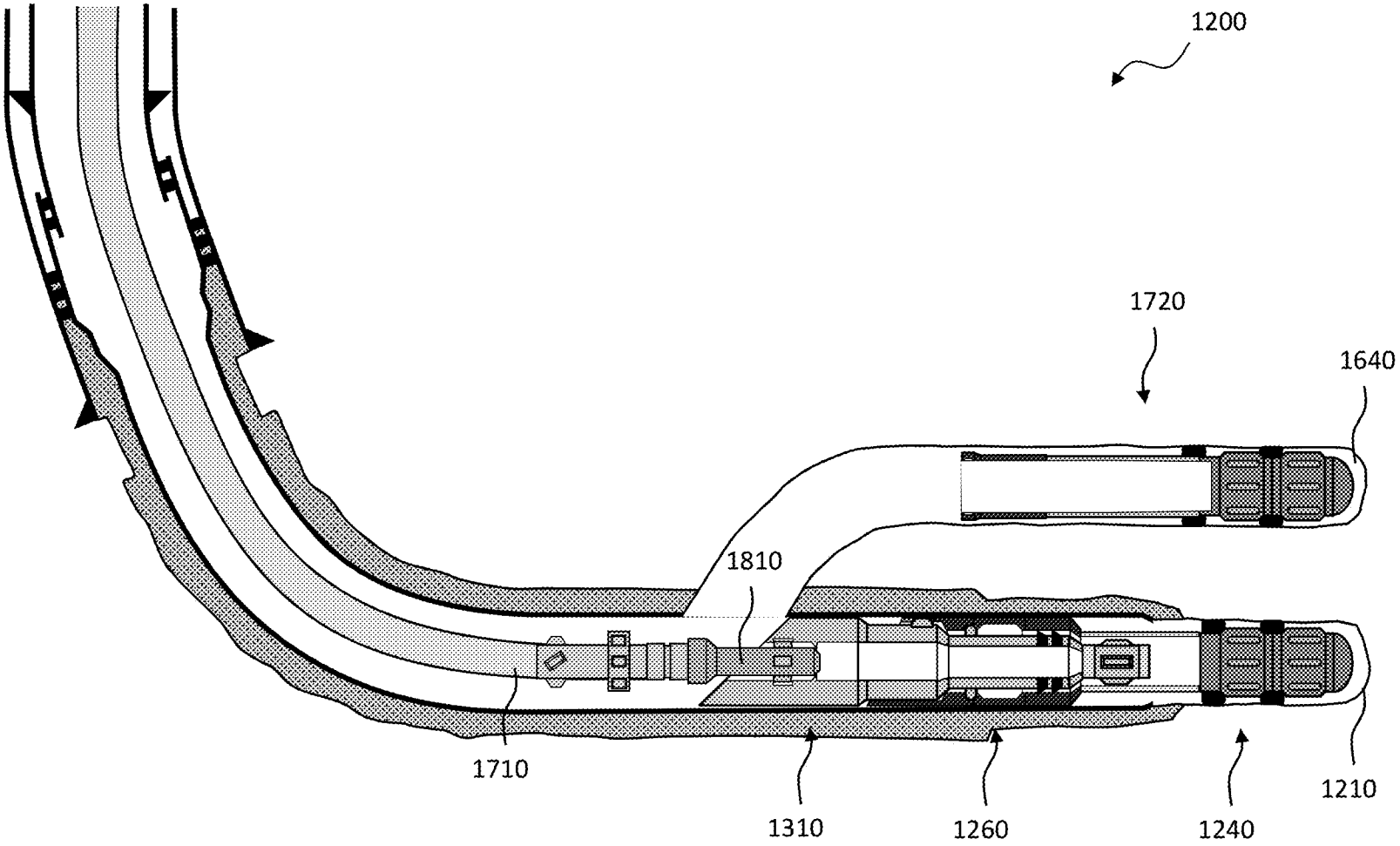

Turning to FIG. 18, illustrated is the well system 1200 of FIG. 17 after latching a whipstock retrieval tool 1810 of the inner string 1710 with a profile in the whipstock assembly 1310. The whipstock assembly 1310 may then be pulled free from the anchor system 1260, and then pulled out of hole. What results are the main wellbore completion 1240 in the main wellbore 1210, and the lateral wellbore completion 1720 in the lateral wellbore 1640. In at least one embodiment lateral wellbore completion 1720 may comprise an Energy Transfer Mechanism (ETM), a Wireless Energy Transfer Mechanism, and/or a Wet-Mate for energy/power/communications/control/data transfer.

Lateral wellbore completion 1720, in one or more embodiments, may comprise one or more sensor, recorder, actuator, choking mechanism, flow restrictor, pressure-drop device, venturi tube containing device. In at least one embodiment, lateral wellbore completion 1720 may comprise a control line, a production and reservoir management system with in-situ measurements of pressure, temperature, flow rate, and water cut across the formation face in multiple zones of each wellbore. Sensors may be packaged in one station with a flow control valve that has variable settings controlled from surface through one or more electrical, fiber optic, hydraulic control lines. Multiple stations may be used to maximize hydrocarbon sweep and recovery with fewer wells, reducing capex, opex, and surface footprint.

Figure 19:
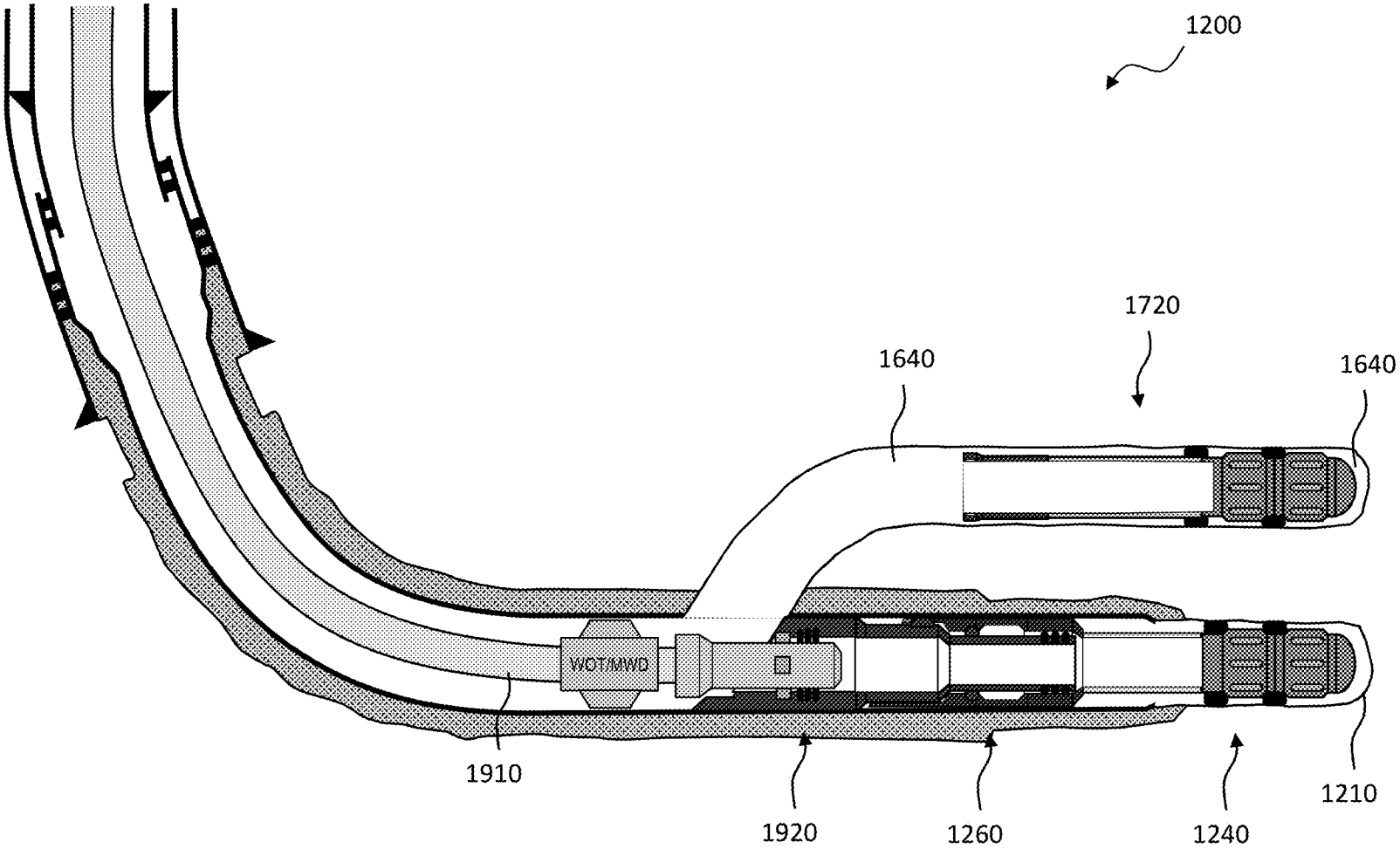

Turning to FIG. 19, illustrated is the well system 1200 of FIG. 18 after employing a running tool 1910 to install a deflector assembly 1920 proximate a junction between the main wellbore 1210 and the lateral wellbore 1640. The deflector assembly 1920 may be appropriately oriented using the WOT/MWD tool. The running tool 1910 may then be pulled out of hole. In some embodiments, deflector assembly 1920 may comprise one, or more than one, or all components and systems mentioned that could be run with main wellbore completion 1240 (e.g. valves, control lines, sensors). In some embodiments, deflector assembly 1920 may comprise components that may compliment items run with main wellbore completion 1240. For example, deflector assembly 1920 may comprise a male Energy Transfer Mechanism to functionally work with a female Energy Transfer Mechanism (ETM) run with main wellbore completion 1240.

Figure 20:
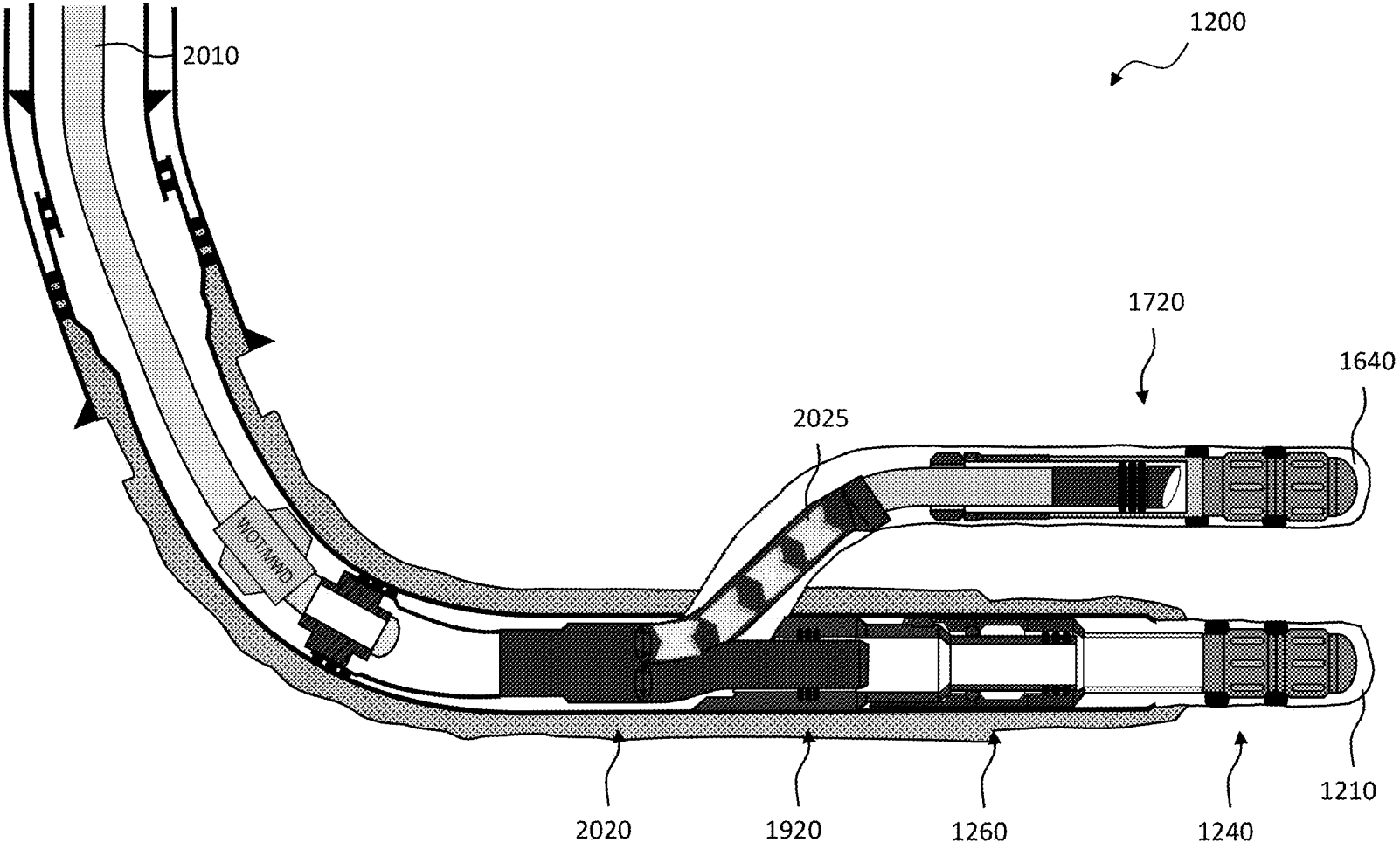

Turning to FIG. 20, illustrated is the well system 1200 of FIG. 19 after employing a running tool 2010 to place a multilateral junction 2020 proximate an intersection between the main wellbore 1210 and the lateral wellbore 1910. In accordance with one embodiment, the multilateral junction 2020 may include similar features as the multilateral junctions 200, 300, 400, 900*a*, 800*b*, 900, 1000, among others, discussed above. Accordingly, the multilateral junction 2020 may have one or more articulating structures 2025 designed, manufactured and operated according to the disclosure. As discussed above, the articulating structures 2025 of the embodiment of FIG. 20 allow the lateral wellbore leg of the multilateral junction 2020 to flex into the lateral wellbore 1640 and engage with the lateral wellbore completion 1720. Multilateral junction 2020, in one or more embodiments, may comprise one or more connector, sensor, recorder, actuator, choking mechanism, flow restrictor, pressure-drop device, venturi tube containing device.

In at least one embodiment, multilateral junction 2020 may comprise a control line, a production and reservoir management system with in-situ measurements of pressure, temperature, flow rate, and water cut across the formation face in multiple zones of each wellbore. Sensors may be packaged in one station with a flow control valve that has variable settings controlled from surface through one or more electrical, fiber optic, hydraulic control lines. Multiple stations may be used to maximize hydrocarbon sweep and recovery with fewer wells, reducing capex, opex, and surface footprint.

In some embodiments, multilateral junction 2020 may comprise one, or more than one, or all components and systems mentioned that could be run with main wellbore completion 1240 and/or lateral wellbore completion 1720 (e.g. valves, control lines, sensors). In some embodiments, multilateral junction 2020 may comprise components that may compliment items run with main wellbore completion 1240 and/or lateral wellbore completion 1720. For example, multilateral junction 2020 may comprise a male Energy Transfer Mechanism to functionally work with a female Energy Transfer Mechanism (ETM) run with main wellbore completion 1240. Likewise, deflector assembly 1920 may comprise a male Inductive Coupler—a form of a Wireless Energy Transfer Mechanism—to functionally work with a female Inductive Coupler run as part of the lateral wellbore completion 1720. The goal is to provide a multilateral junction 2020 capable of complimenting the use of a production and reservoir management system within multiple wellbores with a goal of maximize hydrocarbon sweep and recovery with fewer wells, reducing capex, opex, and surface footprint. In one or more embodiments, the items/systems/methods mentioned in the previous two paragraphs may be run with a tubing string affixed to one or more of multilateral junction 2020's lateral legs 140, 150 and/or mainbore leg(s).

Figure 21:
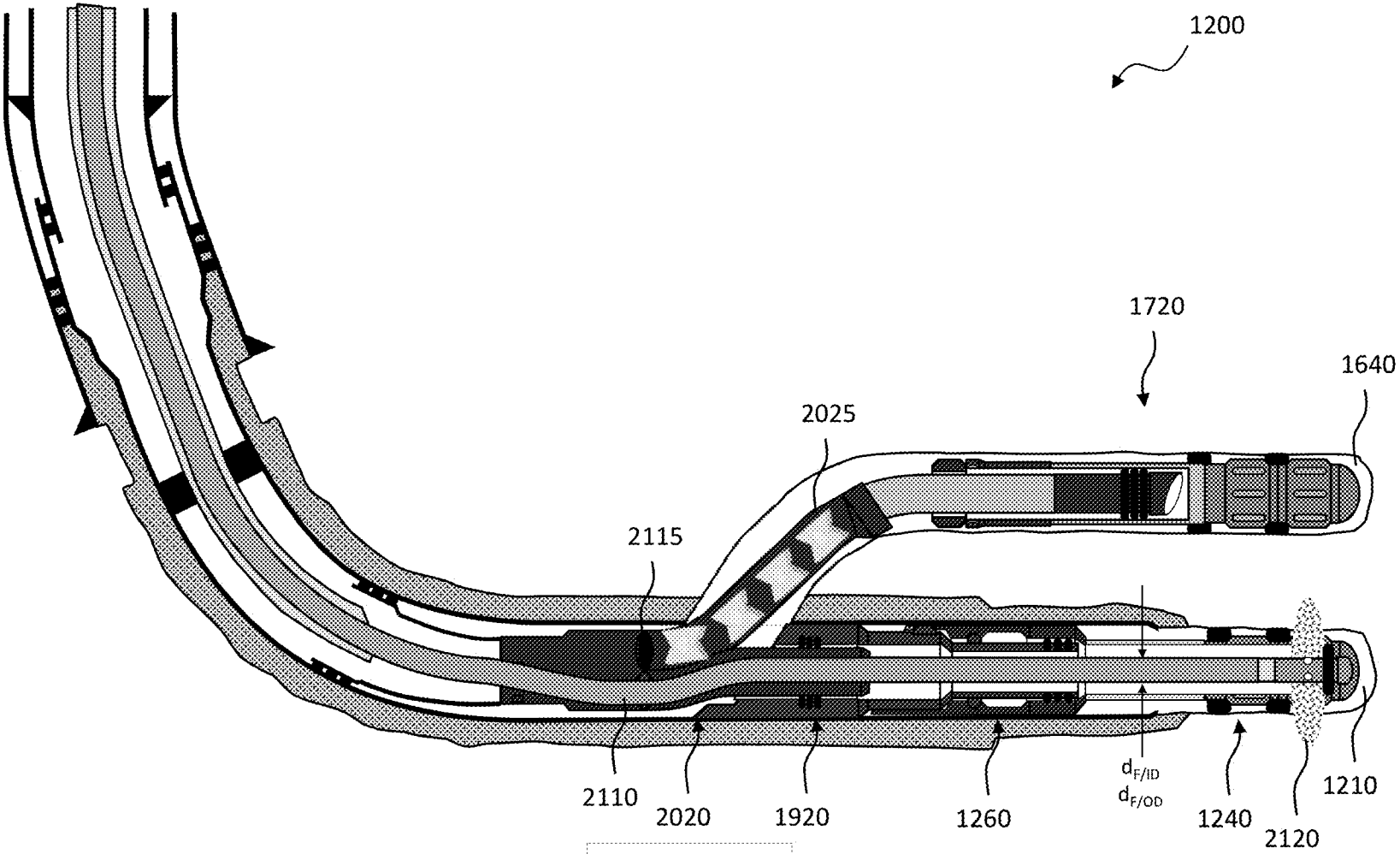

Turning to FIG. 21, illustrated is the well system 1200 of FIG. 20 after selectively accessing the main wellbore 1210 with a first intervention tool 2110 through the y-block of the multilateral junction 2020. In the illustrated embodiment, the first intervention tool 2110 is a first fracturing string, and more particularly a coiled tubing conveyed fracturing string. In at least one embodiment, one or more seals 2115 may seal a portion of the multilateral junction 2020, including the lateral leg thereof. With the first intervention tool 2110 in place, fractures 2120 in the subterranean formation surrounding the main wellbore completion 1240 may be formed. Thereafter, the first intervention tool 2110 may be pulled from the main wellbore completion 1240.

Figure 22:
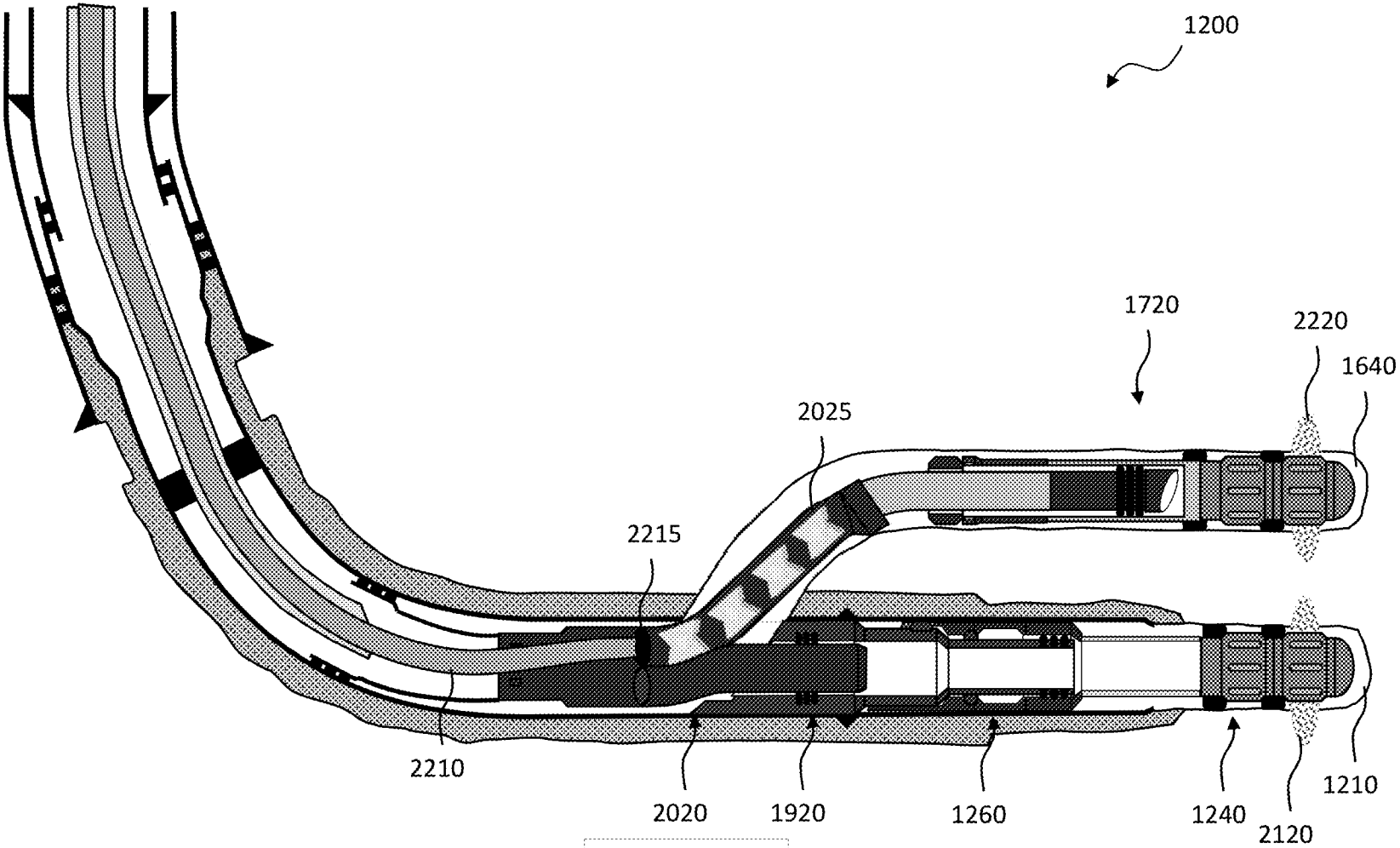

Turning to FIG. 22, illustrated is the well system 1200 of FIG. 21 after positioning a second intervention tool 2210 within the multilateral junction 2020 including the y-block. In the illustrated embodiment, the second intervention tool 2210 is a second fracturing string, and more particularly a coiled tubing conveyed fracturing string. In at least one embodiment, one or more seals 2215 seal the second intervention tool with the multilateral junction 2210. With the downhole tool 2210 in place, fractures 2220 in the subterranean formation surrounding the lateral wellbore completion 1720 may be formed. For example, the fractures 2220 surrounding the lateral wellbore completion 1720 may be formed with fluid passing around the one or more articulating structures 2025.

In certain embodiments, the first intervention tool 2110 and the second intervention tool 2210 are the same intervention tool, and thus the same fracturing tool in one or more embodiments. In other embodiments, the first intervention tool 2110 and the second intervention tool 2210 are different intervention tools, and thus the different fracturing tool may be utilized in one or more embodiments. For example, the first intervention tool 2110 and associated fracturing tool may be smaller so the tools can pass through the Junction's mainbore leg. In this type of scenario, another stimulation system/method, such as Pinpoint stimulation system may be preferred so that smaller-diameter tools and lower injection rates are required. In other embodiments, it may be preferred to use a larger-diameter second intervention tool 2210 since it may not be required to pass through the lateral leg of the junction. A larger-diameter second intervention tool 2210 may have the advantage of being able to withstand higher pumping rates (higher fluid velocities). High pump rates (>30 BPM in 2" Coiled Tubing) may cause erosion to the tubing and premature failure. Thereafter, the second intervention tool 2210 may be pulled from the multilateral junction 2020 and out of the hole.

Figure 23:
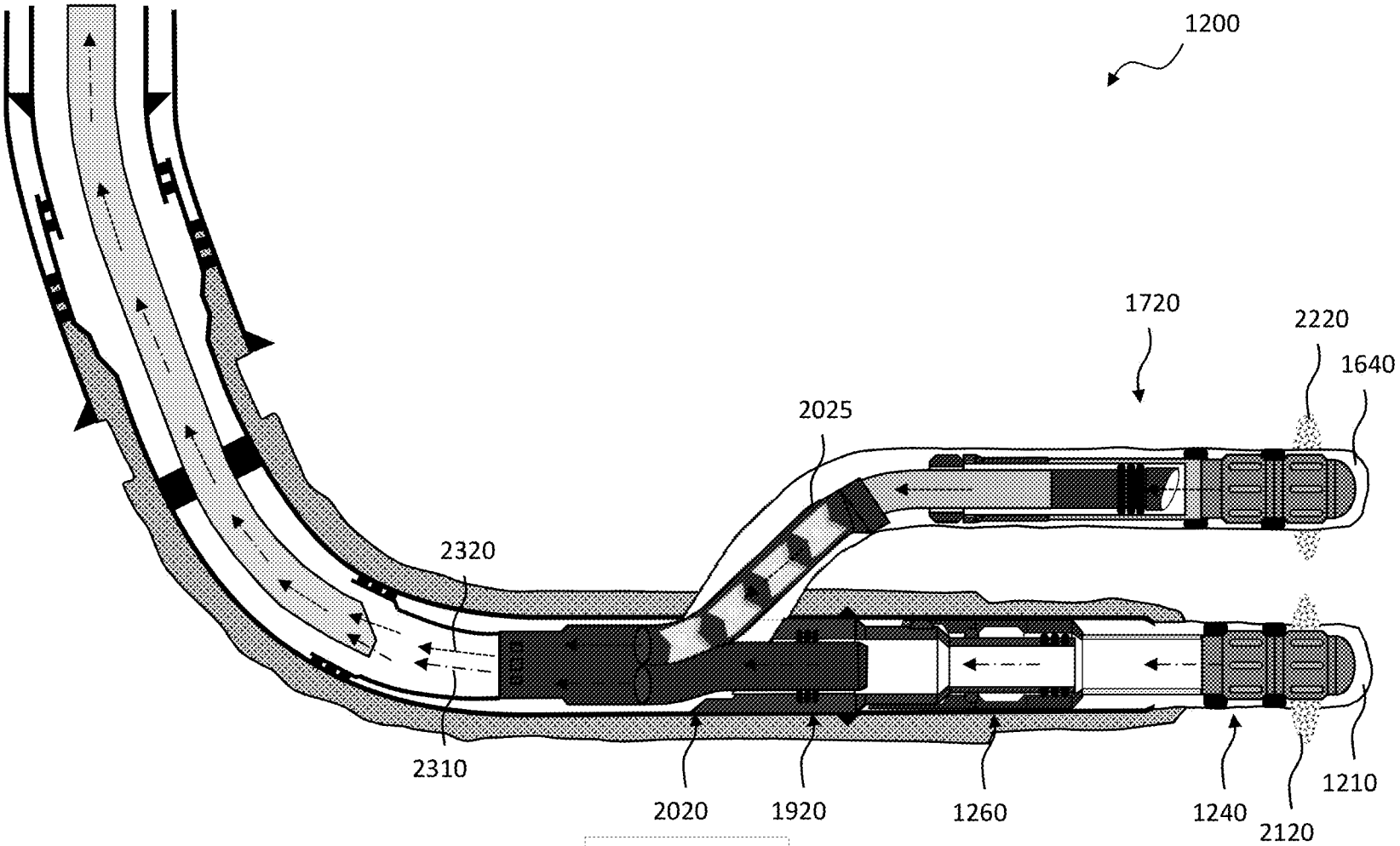

Turning to FIG. 23, illustrated is the well system 1200 of FIG. 22 while producing fluids 2310 from the fractures 2120 in the main wellbore 1210, and producing fluids 2320 from the fractures 2220 in the lateral wellbore 1640. The producing of the fluids 2310, 2320 occur through the multilateral junction 2020, and more specifically through the articulating structures 2025 designed, manufactured and operated according to one or more embodiments of the disclosure.

Aspects disclosed herein include:

A. A wellbore leg, the wellbore leg including: 1) a tubular having a fluid passageway extending there through; and 2) an articulating structure located within the fluid passageway, the articulating structures including: a) a first portion; and b) a second portion, wherein the first portion and the second portion are coupled to one another and operable to rotate relative to one another.

B. A multilateral junction, the multilateral junction including: 1) a y-block, the y-block including; a) a housing having a first end and a second opposing end; b) a single first bore extending into the housing from the first end; and c)

second and third separate bores extending into the housing and branching off from the single first bore; 2) a mainbore leg coupled to the second bore for extending into a main wellbore; and 3) a lateral bore leg coupled to the third bore for extending into a lateral wellbore, wherein the lateral bore leg includes: a) a tubular having a fluid passageway extending there through; and b) ten or more articulating structures located within the fluid passageway, each of the ten or more articulating structures including: i) a first portion; and ii) a second portion, wherein the first portion and the second portion are coupled to one another and operable to rotate relative to one another.

C. A well system, the well system including: 1) a main wellbore; 2) a lateral wellbore extending from the main wellbore; and 3) a multilateral junction positioned at an intersection of the main wellbore and the lateral wellbore, the multilateral junction including; a) a y-block, the y-block including; i) a housing having a first end and a second opposing end; ii) a single first bore extending into the housing from the first end; and iii) second and third separate bores extending into the housing and branching off from the single first bore; b) a mainbore leg coupled to the second bore for extending into a main wellbore; and c) a lateral bore leg coupled to the third bore for extending into a lateral wellbore, wherein the lateral bore leg includes: i) a tubular having a fluid passageway extending there through; and ii) an articulating structures located within the fluid passageway, the articulating structures including: a first portion and a second portion, wherein the first portion and the second portion are coupled to one another and operable to rotate relative to one another.

Aspects A, B, and C may have one or more of the following additional elements in combination: Element 1: wherein at least one of the first portion or the second portion is rigidly coupled to the tubular. Element 2: wherein both of the first portion and the second portion are rigidly coupled to the tubular. Element 3: wherein the tubular has first and second oppositely oriented slots extending through a sidewall thereof, the first portion exposed through the first slot and the second portion exposed through the second slot for rigidly coupling the first portion and the second portion to the tubular. Element 4: wherein the articulating structure is a first articulating structure and further including a second articulating structure positioned adjacent the first articulating structure, wherein each of the first and second articulating structures includes a width (w), a thickness (t), and a height (h), and further wherein a spacing (s) between the first and second articulating structures is less than the width (w). Element 5: wherein the articulating structure is a first articulating structure and further including a second articulating structure positioned adjacent the first articulating structure, wherein each of the first and second articulating structures includes a width (w), a thickness (t), and a height (h), and further wherein a spacing (s) between the first and second articulating structures is less than ½ the width (w). Element 6: wherein the articulating structure includes a width (w), a thickness (t), and a height (h), the first portion and the second portion having openings extending through their thicknesses (t), and further including a pin extending through the openings to provide an axis of rotation. Element 7: wherein the openings have a diameter ($D_o$) and the pin has a diameter ($D_p$), and further wherein the diameter ($D_p$) is less than 95% the diameter ($D_o$). Element 8: wherein the first portion includes a tongue feature and the second portion includes a groove feature, the tongue feature of the first portion extending within the groove feature. Element 9: wherein the groove feature and the tongue feature provide associated bearing surfaces for the first portion and the second portion to rotate against each other. Element 10: wherein the articulating structure includes a locking feature operable to keep the articulating structure in a non-rotated state for installation. Element 11: wherein the tubular is a D-shaped tubular, and further including a D to round member coupled to an end of the tubular, the D to round member including a recess large enough to allow the articulating structure to be insert into the tubular through the D to round member. Element 12: wherein the articulating structure is a first articulating structure and further including nine or more additional articulating structures located within the tubular, each of the ten or more articulating structures including the first portion and the second portion operable to rotate relative to one another. Element 13: wherein the first articulating structure and nine or more additional articulating structures are axially attached to one another to fix a spacing (s) between the first articulating structure and the ten or more additional articulating structures. Element 14: wherein at least one of the first portions or the second portions are rigidly coupled to the tubular. Element 15: wherein the tubular has a plurality of first and plurality of second oppositely oriented slots extending through a sidewall thereof, the first portions exposed through ones of the first slots and the second portions exposed through ones of the second slots for rigidly coupling the first portions and the second portions to the tubular. Element 16: wherein each of the ten or more articulating structures includes a width (w), a thickness (t), and a height (h), and further wherein a spacing (s) between adjacent articulating structures is less than the width (w). Element 17: wherein the first portions include a tongue feature and the second portions include a groove feature, the tongue features of the first portions extending within the groove features, and further wherein the groove features and the tongue features provide associated bearing surfaces for related first portions and second portions to rotate against each other. Element 18: further including ten or more main wellbore articulating structures located within the main wellbore leg, each of the ten or more main wellbore articulating structures including the first portion and the second portion operable to rotate relative to one another. Element 19: further including one or more support structures located within the third separate bore. Element 20: wherein the one or more support structures are one or more y-block articulating structures including the first portion and the second portion operable to rotate relative to one another. Element 21: wherein at least one of the first portions or the second portions are rigidly coupled to the tubular. Element 22: wherein the tubular has a plurality of first and plurality of second oppositely oriented slots extending through a sidewall thereof, the first portions exposed through ones of the first slots and the second portions exposed through ones of the second slots for rigidly coupling the first portions and the second portions to the tubular. Element 23: wherein each of the ten or more articulating structures includes a width (w), a thickness (t), and a height (h), and further wherein a spacing (s) between adjacent articulating structures is less than the width (w). Element 24: wherein the first portions include a tongue feature and the second portions include a groove feature, the tongue features of the first portions extending within the groove features, and further wherein the groove features and the tongue features provide associated bearing surfaces for related first portions and second portions to rotate against each other. Element 25: further including ten or more main wellbore articulating structures located within the main wellbore leg, each of the ten or more main wellbore articulating structures including the first portion and the second portion operable to rotate relative to one another. Element 26: further including one or more support structures located within the third separate bore. Element 27: wherein the one or more support structures are one or more y-block articulating structures including the first portion and the second portion operable to rotate relative to one another.

Those skilled in the art to which this application relates will appreciate that other and further additions, deletions, substitutions and modifications may be made to the described embodiments.

What is claimed is:

1. A wellbore leg, comprising:

a tubular having a fluid passageway extending there through; and an articulating structure located within the fluid passageway, the articulating structure including:

a first portion; and a second portion, wherein the first portion and the second portion are coupled to one another and operable to rotate relative to one another, wherein the articulating structure includes a width (w), a thickness (t), and a height (h), each of the first portion and the second portion having openings, and further including a pin extending at least partially through the openings to provide an axis of rotation, wherein the articulating structure is a first articulating structure and further including a second articulating structure positioned adjacent the first articulating structure, wherein each of the first and second articulating structures includes a width (w), a thickness (t), and a height (h), and further wherein a spacing (s) between the first and second articulating structures is less than the width (w).

2. The wellbore leg as recited in claim 1, wherein at least one of the first portion or the second portion is rigidly coupled to the tubular.

3. The wellbore leg as recited in claim 2, wherein both of the first portion and the second portion are rigidly coupled to the tubular.

4. The wellbore leg as recited in claim 3, wherein the tubular has first and second oppositely oriented slots extending through a sidewall thereof, the first portion exposed through the first slot and the second portion exposed through the second slot for rigidly coupling the first portion and the second portion to the tubular.

5. The wellbore leg as recited in claim 1, further wherein the spacing (s) between the first and second articulating structures is less than ½ the width (w).

6. The wellbore leg as recited in claim 1, wherein the pin extends entirely through the openings to provide the axis of rotation.

7. The wellbore leg as recited in claim 6, wherein the openings have a diameter ($D_o$) and the pin has a diameter ($D_p$), and further wherein the diameter ($D_p$) is less than 95% the diameter ($D_o$).

8. The wellbore leg as recited in claim 1, wherein the first portion includes a tongue feature and the second portion includes a groove feature, the tongue feature of the first portion extending within the groove feature.

9. The wellbore leg as recited in claim 8, wherein the groove feature and the tongue feature provide associated bearing surfaces for the first portion and the second portion to rotate against each other.

10. The wellbore leg as recited in claim 1, wherein the articulating structure includes a locking feature operable to keep the articulating structure in a non-rotated state for installation.

11. The wellbore leg as recited in claim 1, wherein the tubular is a D-shaped tubular, and further including a D-to-round member coupled to an end of the tubular, the D-to-round member including a recess large enough to allow the articulating structure to be inserted into the tubular through the D-to-round member.

12. The wellbore leg as recited in claim 1, wherein the articulating structure is a first articulating structure and further including nine or more additional articulating structures located within the tubular, each of the nine or more additionally articulating structures including another first portion and another second portion operable to rotate relative to one another.

13. The wellbore leg as recited in claim 12, wherein the first articulating structure and nine or more additional articulating structures are axially attached to one another to fix a spacing (s) between the first articulating structure and the nine or more additional articulating structures.

14. A multilateral junction, comprising:

a y-block, the y-block including;

a housing having a first end and a second opposing end;

a single first bore extending into the housing from the first end; and second and third separate bores extending into the housing and branching off from the single first bore;

a mainbore leg coupled to the second bore for extending into a main wellbore; and a lateral bore leg coupled to the third bore for extending into a lateral wellbore, wherein the lateral bore leg includes:

a tubular having a fluid passageway extending there through; and ten or more articulating structures located within the fluid passageway, each of the ten or more articulating structures including:

a first portion; and a second portion, wherein the first portion and the second portion are coupled to one another and operable to rotate relative to one another.

15. The multilateral junction as recited in claim 14, wherein at least one of the first portions or the second portions are rigidly coupled to the tubular.

16. The multilateral junction as recited in claim 15, wherein the tubular has a plurality of first and plurality of second oppositely oriented slots extending through a sidewall thereof, the first portions exposed through ones of the first slots and the second portions exposed through ones of the second slots for rigidly coupling the first portions and the second portions to the tubular.

17. The multilateral junction as recited in claim 14, wherein each of the ten or more articulating structures includes a width (w), a thickness (t), and a height (h), and further wherein a spacing (s) between adjacent articulating structures is less than the width (w).

18. The multilateral junction as recited in claim 14, wherein the first portions include a tongue feature and the second portions include a groove feature, the tongue features of the first portions extending within the groove features, and further wherein the groove features and the tongue features provide associated bearing surfaces for related first portions and second portions to rotate against each other.

19. The multilateral junction as recited in claim 14, further including ten or more main wellbore articulating structures located within the main wellbore leg, each of the ten or more main wellbore articulating structures including the first portion and the second portion operable to rotate relative to one another.

20. The multilateral junction as recited in claim 14, further including one or more support structures located within the third separate bore.

21. The multilateral junction as recited in claim 20, wherein the one or more support structures are one or more y-block articulating structures each including the first portion and the second portion operable to rotate relative to one another.

22. A well system, comprising:

a main wellbore;

a lateral wellbore extending from the main wellbore; and a multilateral junction positioned at an intersection of the main wellbore and the lateral wellbore, the multilateral junction including;

a y-block, the y-block including;

a housing having a first end and a second opposing end;

a single first bore extending into the housing from the first end; and second and third separate bores extending into the housing and branching off from the single first bore;

a mainbore leg coupled to the second bore for extending into a main wellbore; and a lateral bore leg coupled to the third bore for extending into a lateral wellbore, wherein the lateral bore leg includes:

a tubular having a fluid passageway extending there through; and articulating structures located within the fluid passageway, each of the articulating structures including:

a first portion; and a second portion, wherein the first portion and the second portion are coupled to one another and operable to rotate relative to one another.

23. The well system as recited in claim 22, wherein at least one of the first portions or the second portions are rigidly coupled to the tubular.

24. The well system as recited in claim 23, wherein the tubular has a plurality of first and a plurality of second oppositely oriented slots extending through a sidewall thereof, the first portions exposed through ones of the first slots and the second portions exposed through ones of the second slots for rigidly coupling the first portions and the second portions to the tubular.

25. The well system as recited in claim 22, wherein each of the articulating structures includes a width (w), a thickness (t), and a height (h), and further wherein a spacing (s) between adjacent articulating structures is less than the width (w).

26. The well system as recited in claim 22, wherein each of the first portions include a tongue feature and each of the second portions include a groove feature, the tongue features of the first portions extending within the groove features, and further wherein the groove features and the tongue features provide associated bearing surfaces for related first portions and second portions to rotate against each other.

27. The well system as recited in claim 22, further including ten or more main wellbore articulating structures located within the main wellbore leg, each of the ten or more main wellbore articulating structures including the first portion and the second portion operable to rotate relative to one another.

28. The well system as recited in claim 22, further including one or more support structures located within the third separate bore.

29. The well system as recited in claim 28, wherein the one or more support structures are one or more y-block articulating structures including the first portion and the second portion operable to rotate relative to one another.

* * * * *